US009716312B2

(12) United States Patent
Chen et al.

(10) Patent No.: US 9,716,312 B2
(45) Date of Patent: Jul. 25, 2017

(54) MULTIPLE-INPUT MULTIPLE-OUTPUT ULTRA-WIDEBAND ANTENNAS

(71) Applicant: OHIO STATE INNOVATION FOUNDATION, Columbus, OH (US)

(72) Inventors: Chi-Chih Chen, Dublin, OH (US); John L. Volakis, Columbus, OH (US); Ersin Yetisir, Columbus, OH (US)

(73) Assignee: Ohio State Innovation Foundation, Columbus, OH (US)

( * ) Notice: Subject to any disclaimer, the term of this patent is extended or adjusted under 35 U.S.C. 154(b) by 0 days.

(21) Appl. No.: 14/760,359

(22) PCT Filed: Jan. 13, 2014

(86) PCT No.: PCT/US2014/011302

§ 371 (c)(1),
(2) Date: Jul. 10, 2015

(87) PCT Pub. No.: WO2014/110508

PCT Pub. Date: Jul. 17, 2014

(65) Prior Publication Data

US 2015/0357720 A1 Dec. 10, 2015

Related U.S. Application Data

(60) Provisional application No. 61/751,406, filed on Jan. 11, 2013, provisional application No. 61/869,194, filed on Aug. 23, 2013.

(51) Int. Cl.

| | |
|---|---|
| ***H01Q 21/00*** | (2006.01) |
| ***H01Q 1/52*** | (2006.01) |
| ***H01Q 9/28*** | (2006.01) |
| ***H01Q 9/40*** | (2006.01) |
| ***H01Q 21/26*** | (2006.01) |
| ***H01Q 21/28*** | (2006.01) |

(52) U.S. Cl.
CPC ..... *H01Q 1/521* (2013.01); *H01Q 9/28* (2013.01); *H01Q 9/285* (2013.01); *H01Q 9/40* (2013.01); *H01Q 21/26* (2013.01); *H01Q 21/28* (2013.01)

(58) Field of Classification Search
CPC ..... H01Q 1/3275; H01Q 3/24; H01Q 7/00; H01Q 25/00; H01Q 21/24; H01Q 21/26; H01Q 9/30

(Continued)

(56) References Cited

U.S. PATENT DOCUMENTS 5,264,862 A 11/1993 Kumpfbeck
6,812,902 B2 * 11/2004 Rossman ..... H01Q 9/0464 343/700 MS (Continued)

OTHER PUBLICATIONS

International Search Report and Written Opinion of the U.S. International Searching Authority from International Application No. PCT/US2014/011302, mailed May 2, 2014.

(Continued)

*Primary Examiner* — Linh Nguyen
(74) *Attorney, Agent, or Firm* — Meunier Carlin & Curfman LLC

(57) ABSTRACT

An example ultra-wideband ("UWB") multiple-input multiple-output ("MIMO") antenna operating across a continuous, wide-range frequency band can include a ground plane, a wideband monopole antenna arranged over the ground plane, and a ring antenna arranged over the ground plane and around the wideband monopole antenna. The ring antenna can include a plurality of pairs of dipole antennas, where these dipole pairs are configured for symmetric, out-of-phase coupling with the wideband monopole antenna. The wideband monopole antenna and the ring antenna can also be configured to generate respective electric fields having orthogonal polarizations.

32 Claims, 16 Drawing Sheets

(58) Field of Classification Search
USPC ..... 343/726, 727, 728, 741, 742, 866, 867, 343/725
See application file for complete search history.

(56) References Cited

U.S. PATENT DOCUMENTS

| | | | | |
|---|---|---|---|---|
| 7,710,343 | B2 | 5/2010 | Chiu et al. | |
| 8,193,989 | B2 * | 6/2012 | Fujita | H01Q 1/007 343/700 MS |
| 2003/0210193 | A1 * | 11/2003 | Rossman | H01Q 9/0464 343/725 |
| 2008/0227487 | A1 | 9/2008 | Daniels et al. | |
| 2009/0073072 | A1 * | 3/2009 | Lindenmeier | H01Q 1/3275 343/810 |
| 2009/0289865 | A1 | 11/2009 | Parsche | |
| 2010/0253587 | A1 | 10/2010 | Lindenmeier et al. | |
| 2011/0018782 | A1 | 1/2011 | Lu et al. | |
| 2012/0025848 | A1 * | 2/2012 | Hasch | B23D 59/005 324/640 |
| 2012/0050120 | A1 * | 3/2012 | Lindenmeier | H01Q 1/3275 343/732 |
| 2013/0106667 | A1 * | 5/2013 | Fenn | H01Q 1/525 343/793 |
| 2014/0203981 | A1 * | 7/2014 | Nakano | H01Q 1/521 343/749 |
| 2015/0070234 | A1 * | 3/2015 | Jones | H01Q 1/12 343/798 |
| 2015/0116173 | A1 * | 4/2015 | Zhang | H01Q 1/36 343/794 |
| 2016/0072196 | A1 * | 3/2016 | Boyer | H01Q 9/16 343/727 |

OTHER PUBLICATIONS

Bayraktar, Z., Gregory, M., & Werner, D. H. Composite planar double-sided AMC surfaces for MIMO applications. In Antennas and Propagation Society International Symposium, Jun. 2009.

Chiu, C. Y. et al. Reduction of Mutual Coupling between Closely-Packed Antenna Elements. IEEE Trans. Antennas Propag. 55(6): 1732-1738, Jun. 2007.

Chou, J-H. and Su, S-W., Internal Wideband Monopole Antenna for MIMO Access-Point Applications in WLAN/WIMAX Bands. Microw. Opt. Technol. Lett. 50(5): 1146-1148, May 2008.

Elsherbini, A. and Sarabandi, K. Dual-Polarized Coupled Sectorial Loop Antennas for UWB Applications. IEEE Antennas Wireless Propag. Lett. 10: 75-78, 2011.

Hu, S., Pan, J., and Qiu, J. A Compact Polarization Diversity MIMO Microstrip Patch Antenna Array with Dual Slant Polarizations. IEEE APS-URSI International Symposium. 2009.

Kempel, L.C. and Volakis, J, L. TM Scattering by a Metallic Half Pane with a Resistive Sheet Extension. IEEE Trans. Antennas Propag. 41(7): 910-917, Jul. 1993.

Li, Y. et al. Compact Azimuthal Omnidirectional Dual-Polarized Antenna Using Highly Isolated Colocated Slots. IEEE Trans. Antennas Propag. 60(9): 4037-4045, Sep. 2012.

Lu, Y.C. and Lin, Y.C. A Compact Dual-Polarized UWB Antenna with High Port Isolation. IEEE APS-URSI International Symposium. 2010.

Minz, L. and Garg, R. Reduction of Mutual Coupling between Closely Spaced PIFAs. Electron. Lett. 46(6): 392-394, Mar. 2010.

Roberts, W.K. A New Wideband Balun. Proceedings of the IRE. 45(12): 1628-1631, Dec. 1957.

Su, S-W., and Chang, F-S., High-Gain Dual-Loop Antennas for MIMO Access Points, IEEE Trans. Antennas Propag. 58(7), Jul. 2010.

Su, S-W., and Lee, C-T. Low Cost Dual Loop Antenna System for Dual-WLAN-Band Access-Points. IEEE Trans. Antennas Propag. 59(5): 1652-1659, May 2011.

Yang, J.O., Yang F., and Wang, Z. M, Reducing Mutual Coupling of Closely Spaced Microstrip MIMO Antennas for WLAN Application. IEEE Antennas Wireless Propag. Lett. 10: 310-313, 2011.

Zhu, F.G., Xu, J.D. and Xu, Q. Reduction of Mutual Coupling between Closely-Packed Antenna Elements using Defected Ground Structure. 3rd IEEE International Symposium on Microwave, Antenna, Propag. and EMC Technologies for Wireless Comm. 2009.

* cited by examiner

MULTIPLE-INPUT MULTIPLE-OUTPUT ULTRA-WIDEBAND ANTENNAS

CROSS-REFERENCE TO RELATED APPLICATIONS

This application claims the benefit of U.S. Provisional Patent Application No. 61/751,406, filed on Jan. 11, 2013, entitled "UWB MIMO Antenna with High Isolation," and U.S. Provisional Patent Application No. 61/869,194, filed on Aug. 23, 2013, entitled "Ultra-Wideband, Low Profile MIMO Antenna Pair Having Very Low Coupling," the disclosures of which are expressly incorporated herein by reference in their entireties.

BACKGROUND

Multiple-input multiple-output ("MIMO") antennas provide better performance in terms of data rate and reliability, as compared to single antenna systems. Therefore, MIMO antennas are typically desirable for in-building communication systems. However, making such MIMO antennas with relatively small dimensions, and particularly with a low profile, can be challenging. One challenge is achieving adequate isolation between multiple, co-located transmit and receive antennas of the MIMO antenna. Ultra-wideband ("UWB") performance to cover an entire desired frequency range (e.g., all commercial communication and data bands between 700-2700 MHz) is another major challenge. Further, designing MIMO antennas that combine the benefits of UWB and low coupling between multiple, co-located antennas (i.e., highly-isolated antennas) can prove even more difficult.

SUMMARY

An example UWB MIMO antenna for use across a continuous, wide-range frequency band can include a ground plane, a low-profile, wideband monopole (e.g., a wideband monopole antenna as used herein) arranged over the ground plane, and a ring antenna arranged over the ground plane and around the wideband monopole antenna. The ring antenna can include a plurality of of dipole antenna pairs, where respective dipole antenna pairs are configured for symmetric, out-of-phase coupling with respect to the wideband monopole antenna. The wideband monopole and ring antennas can also be configured to generate respective electric fields having orthogonal polarizations.

Additionally, the respective electric fields generated by the wideband monopole antenna and the ring antenna are highly isolated or decoupled across the continuous, wide-range frequency band. For example, the generation of respective electric fields having orthogonal polarizations and/or symmetrical, out-of-phase coupling between the wideband monopole antenna and the dipole antenna pairs can provide high isolation between the two antennas across the continuous, wide-range frequency band. Optionally, the high isolation can be at least 35 dB. Alternatively or additionally, the wideband monopole and ring antennas can be further configured to generate a substantially omnidirectional radiation pattern, for example in an azimuth plane, over the continuous, wide-range frequency band. Alternatively or additionally, the continuous, wide-range frequency band can optionally range from approximately 0.7 GHz to 2.7 GHz.

The wideband monopole antenna can be a conical monopole antenna having a conical shape that defines an apex and a base opposite to the apex. Additionally, the UWB MIMO antenna can include a conductive plate arranged around the base of the conical monopole antenna. For example, the conductive plate can optionally be approximately square-shaped. Alternatively or additionally, a distance between the apex and the base of the conical monopole antenna can be approximately 0.09λ at the lowest frequency of the continuous, wide-range frequency band. For example, the distance can be approximately 4 cm. Optionally, the UWB MIMO antenna can include a printed circuit board ("PCB") arranged over the ground plane. In addition, the conductive plate can be disposed on the surface of the PCB facing the ground plane.

Additionally, the UWB MIMO antenna can optionally include at least one shorting pin extending between the conductive plate and the ground plane. For example, the UWB MIMO antenna can optionally include four shorting pins, where each respective shorting pin extends between a respective corner of the conductive plate and the ground plane. Additionally, the UWB MIMO antenna can optionally include a slot that is arranged between the conductive plate and base of the conical monopole antenna. The width of the slot can be configured to reduce narrow-band resonance caused by the shorting pins. For example, the width of the slot can optionally be approximately 1.5 mm.

Alternatively or additionally, the ring antenna can be approximately square-shaped. Additionally, the respective dipole antennas forming the ring can optionally be arranged to be on opposite sides of the wideband monopole antenna. Additionally, the respective dipole antennas forming the ring can be configured for operation approximately 180° out-of-phase. Alternatively or additionally, each of the respective dipole antennas can include a plurality of conductive arms extending in opposite directions from an excitation point. Optionally, each of the conductive arms can include a plurality of conductive patches. Additionally, one or more coupling slits can optionally be arranged between the conductive patches of each of the conductive arms. A width or arrangement of the coupling slits can be selected to tune capacitive coupling between the conductive patches. Optionally, the UWB MIMO antenna can include a PCB arranged over the ground plane. In addition, the conductive patches can be disposed on opposite surfaces of the PCB.

Alternatively or additionally, the UWB MIMO antenna can include a first port coupled to the wideband monopole antenna, and a second port coupled the ring antenna. The UWB MIMO antenna can also include a feed network circuit including an input coupled to the second port and a plurality of outputs coupled to the excitation points of each of the respective dipole antennas. Additionally, the feed network circuit can be configured to split power of an excitation signal supplied to the input among the plurality of outputs.

Alternatively or additionally, the excitation signal can generate a unidirectional current in the ring antenna. For example, the UWB MIMO antenna can optionally include a plurality of balun circuits, where each of the balun circuits couples to one of the respective outputs of the feed network circuit and one of the excitation points. Optionally, the balun circuits can be of the Marchand-type. Additionally, the balun circuits can be coupled to supply the excitation signal with opposite polarities to the excitation points of each of the respective dipole antennas.

An example method for communicating radio frequency ("RF") data can include transmitting and receiving the RF data on at least two channels simultaneously. The RF data can be transmitted using a wideband monopole antenna or a ring antenna, and the RF data can be simultaneously received using the other antenna, viz. the wideband monopole antenna or the ring antenna. In other words, the RF data can be transmitted by one antenna and received by the other at substantially the same time. It should be understood that the wideband monopole antenna and/or the ring antenna can be configured/designed according to the descriptions provided herein. The method can also include generating respective electric fields with the wideband monopole antenna and the ring antenna when transmitting the RF data, where the respective electric fields have orthogonal polarizations. Further, the method can include providing symmetrical, out-of-phase coupling between the wideband monopole antenna and the ring antenna.

Similar as above, the respective electric fields generated by the wideband monopole antenna and the ring antenna are highly isolated or decoupled across the continuous, wide-range frequency band. For example, the generation of the respective electric fields having orthogonal polarizations and/or the symmetrical, out-of-phase coupling between the wideband monopole antenna and the ring antenna can provide high isolation between the wideband monopole antenna and the ring antenna across the continuous, wide-range frequency band. Optionally, the high isolation can be at least 35 dB. Alternatively or additionally, the continuous, wide-range frequency band can optionally be between approximately 0.7 GHz and 2.7 GHz.

Alternatively or additionally, the wideband monopole and ring antennas can generate a substantially omnidirectional radiation pattern in an azimuth plane that includes the wideband monopole and ring antennas when transmitting the RF data across the continuous, wide-range frequency band.

Alternatively or additionally, the method can further include feeding the ring antenna to generate a unidirectional current in the ring antenna.

Other systems, methods, features and/or advantages will be or may become apparent to one with skill in the art upon examination of the following drawings and detailed description. It is intended that all such additional systems, methods, features and/or advantages be included within this description and be protected by the accompanying claims.

BRIEF DESCRIPTION OF THE DRAWINGS

The components in the drawings are not necessarily to scale relative to each other. Like reference numerals designate corresponding parts throughout the several views.

FIG. 1A is a diagram illustrating the example UWB MIMO antenna with the conductive parts of the antennas printed on a printed circuit board ("PCB"). FIG. 1B is a diagram illustrating the example UWB MIMO antenna with the PCB removed (e.g., with the conductive parts of the antennas only).

FIG. 5A is a diagram illustrating a perspective view of the example UWB MIMO antenna. FIG. 5B is a diagram illustrating a top view of the example UWB MIMO antenna. FIG. 5C is a diagram illustrating a bottom view of the example dipole antenna. FIG. 5D is a diagram illustrating a side view of the example dipole antenna.

FIG. 8A is a diagram illustrating a first side of the balun circuit (i.e., a front side). FIG. 8B is a diagram illustrating a second side (or opposite side) of the balun circuit (i.e., a back side).

FIG. 10A is a graph illustrating reflection coefficients for the conical monopole antenna between 0.7 GHz and 2.7 GHz. FIG. 10B is a graph lustrating reflection coefficients for the ring antenna between 0.7 GHz and 2.7 GHz.

FIG. 14 illustrates 2D total realized gain for the example conical monopole antenna in the elevation (ϕ) plane. In particular, simulated (solid line) and measured (dashed line) pattern cuts in the elevation plane are shown.

DETAILED DESCRIPTION

Figure 1A:
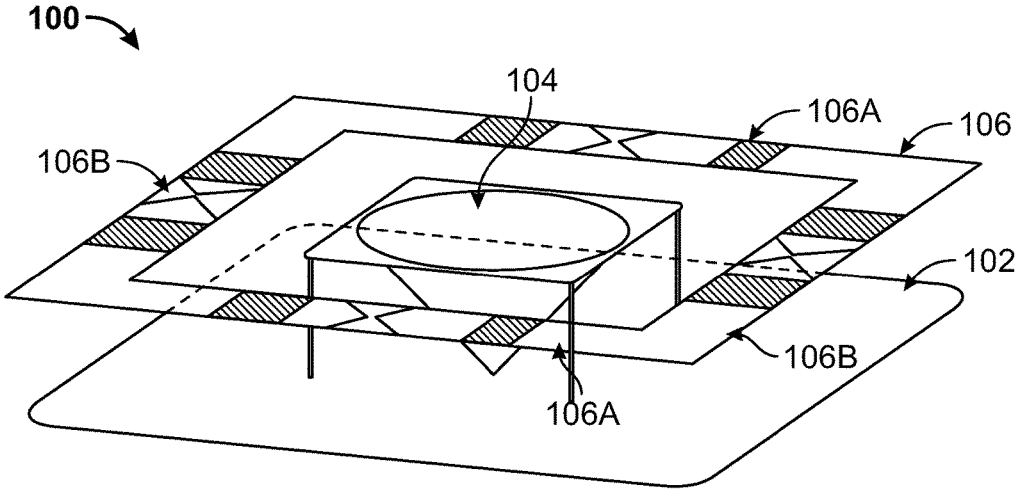
FIGS. 1A-1B are diagrams illustrating perspective views of an example UWB MIMO antenna described herein.

Unless defined otherwise, all technical and scientific terms used herein have the same meaning as commonly understood by one of ordinary skill in the art. Methods and materials similar or equivalent to those described herein can be used in the practice or testing of the present disclosure. As used in the specification, and in the appended claims, the singular forms "a," "an," "the" include plural referents unless the context clearly dictates otherwise. The term "comprising" and variations thereof as used herein is used synonymously with the term "including" and variations thereof and are open, non-limiting terms. The terms "optional" or "optionally" used herein mean that the subsequently described feature, event or circumstance may or may not occur, and that the description includes instances where said feature, event or circumstance occurs and instances where it does not. While implementations will be described for a UWB MIMO antenna designed to operate in the 700-2700 MHz frequency band, it will become evident to those skilled in the art that the implementations are not limited thereto, but are applicable for UWB MIMO antennas operating in other desired frequency bands.

Described herein is an example UWB MIMO antenna. The UWB MIMO antenna is optionally designed to serve as an indoor wireless base station. For example, the UWB MIMO antenna can be designed for wideband (e.g., with a relative bandwidth approximately greater than 2:1) reception and transmission at radio frequency communication and data frequencies over 700-2700 MHz band. As such, the UWB MIMO antenna can serve electronic devices such as mobile communication devices, for example, operating in frequency bands including, but not limited to, the Long Term Evolution ("LTE"), Global System for Mobile Communications ("GSM") and/or Personal Communications Service ("PCS") frequency bands. Alternatively or additionally, the UWB MIMO antenna can provide wireless local area network ("WLAN") data connectivity (e.g., using WI-FI, WIMAX technologies) to portable and/or fixed electronic devices such as personal digital assistants ("PDAs"), smart phones, personal computers, laptop computers, tablet computers, etc.

The example UWB MIMO antenna can include co-located transmit ("TX") and receive ("RX") antennas. The TX and RX antennas can be arranged to achieve extremely low coupling (e.g., extraneous reception from the TX antenna to the RX antenna and vice versa), for example, by exploiting the orthogonal polarization of the TX and RX antennas and/or providing for integrated balanced feeding. The UWB MIMO antenna can be designed to achieve omnidirectional radiation pattern delivering orthogonal polarizations. In addition, the UWB MIMO antenna can be designed as a small, conformal antenna (e.g., having a low profile), which allows for inconspicuous placement of the antenna, for example, in a ceiling of a structure or building. The UWB MIMO antenna can also be designed to achieve impedance matching over a desired frequency range (e.g., 0.7-2.7 GHz). This disclosure contemplates that one or more of the above features contribute to the ability of the UWB MIMO antenna to provide continuous, wideband performance over the desired frequency range (e.g., 0.7-2.7 GHz).

Figure 1B:
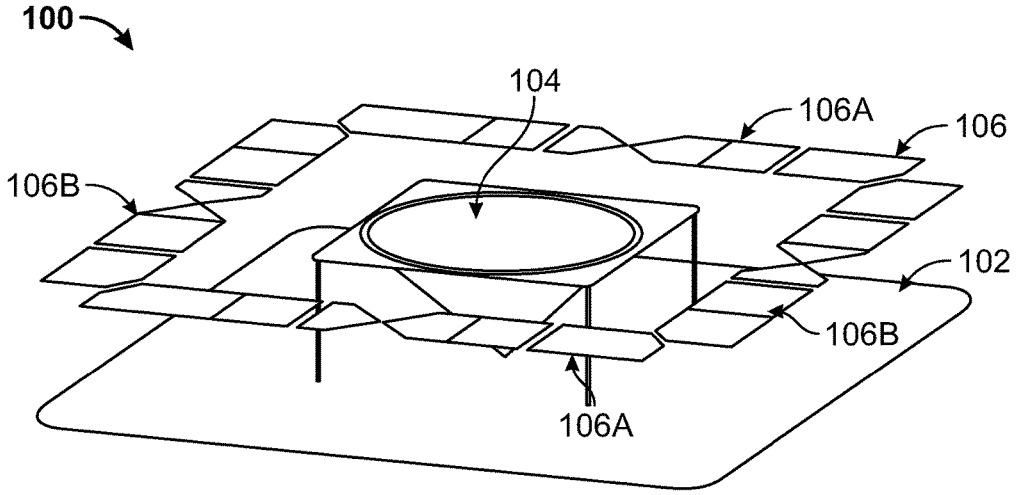

Referring now to FIGS. 1A-1B, diagrams illustrating perspective views of an example UWB MIMO antenna 100 are shown. The UWB MIMO antenna 100 can include co-located TX and RX antennas. For example, the UWB MIMO antenna 100 can include a ground plane 102, a wideband monopole antenna 104 arranged over the ground plane 102, and a ring antenna 106 arranged over the ground plane 102 and around the wideband monopole antenna 104. It should be understood that both the wideband monopole antenna 104 and the ring antenna 106 can be used as the TX and/or RX antenna. As described in the examples below, the wideband monopole antenna can be a conical monopole antenna. Although conical monopole antennas are described in the examples below, this disclosure contemplates using other types of antennas having low profiles (e.g., small, conformal antennas) for use over a wideband frequency range (e.g., antennas having a relative bandwidth $$\left(\frac{fH}{fL}\right)$$

greater than 2:1). The ring antenna 106 can include a plurality of pairs of dipole antennas 106A, 106B. In addition, each pair of dipole antennas 106A, 106B can include respective dipole antennas, which can be configured for symmetric, out-of-phase coupling with the wideband monopole antenna 104. For example, as described in further detail below, the respective dipole antennas for one pair of dipoles can be configured for operation approximately 180° out-of-phase from each other. Due to the symmetrical, out-of-phase coupling, the coupling attributable to each of the respective dipole antennas and the wideband monopole antenna 104, respectively, is canceled out. This contributes to providing high isolation between the wideband monopole antenna 104 and the ring antenna 106. The wideband monopole antenna 104 and the ring antenna 106 can also be configured to generate respective electric fields having orthogonal polarizations. Similar to symmetrical, out-of-phase coupling, generating respective electric fields having orthogonal polarizations contributes to providing high isolation between the wideband monopole antenna 104 and the ring antenna 106. Additionally, the wideband monopole antenna 104 and the ring antenna 106 can be configured to generate a substantially omnidirectional radiation pattern across a continuous, wide-range frequency band. As used herein, the continuous, wide-range frequency band is between approximately 0.7 GHz and 2.7 GHz. It is contemplated that an UWB MIMO antenna can be designed for use across other continuous, wide-range frequency bands using this disclosure.

Isolation between the wideband monopole antenna 104 and the ring antenna 106 refers to low RF coupling, e.g., reducing extraneous reception from the wideband monopole antenna 104 to the ring antenna 106 and vice versa. It should be understood that extraneous reception interferes with the ability to distinguish a signal received at the RX antenna. For example, high isolation between the wideband monopole antenna 104 and the ring antenna 106 can prevent the auto-gain control ("AGC") circuitry of the RX antenna from reducing gain (or amplification) by an amount that is insufficient to amplify weaker RX signals (e.g., signals received at the RX antenna) due to the strong signal coupled from the TX antenna. It should be understood that if gain is reduced too much, the signal-to-noise ratio ("SNR") of the RX signals will be poor, which makes it difficult to distinguish the RX signals. Accordingly, as used herein, "high isolation" refers to at least 35 dB of isolation between the wideband monopole antenna 104 and the ring antenna 106. For example, this disclosure contemplates that high-isolation can refer to at least 40 dB, 50 dB, 60 dB, 70 dB, etc. of isolation between the wideband monopole antenna 104 and the ring antenna 106. As described in detail below, the UWB MIMO antenna 100 can include a first port coupled to the wideband monopole antenna 104, and a second port coupled the ring antenna 106. The arrangement of the wideband monopole antenna 104 and the ring antenna 106 can achieve high isolation between the first and second ports. In addition, the arrangement of the wideband monopole antenna 104 and the ring antenna 106 can achieve high isolation over a continuous, wide-range frequency band (e.g., 0.7-2.7 GHz). In other words, high isolation is achieved at all frequencies over the continuous, wide-range frequency band, for example, as opposed to in one or more selected bands within the continuous, wide-range frequency band. Further, high isolation can be achieved without the assistance of internal circuitry such as AGC circuitry, for example.

Figure 2A:
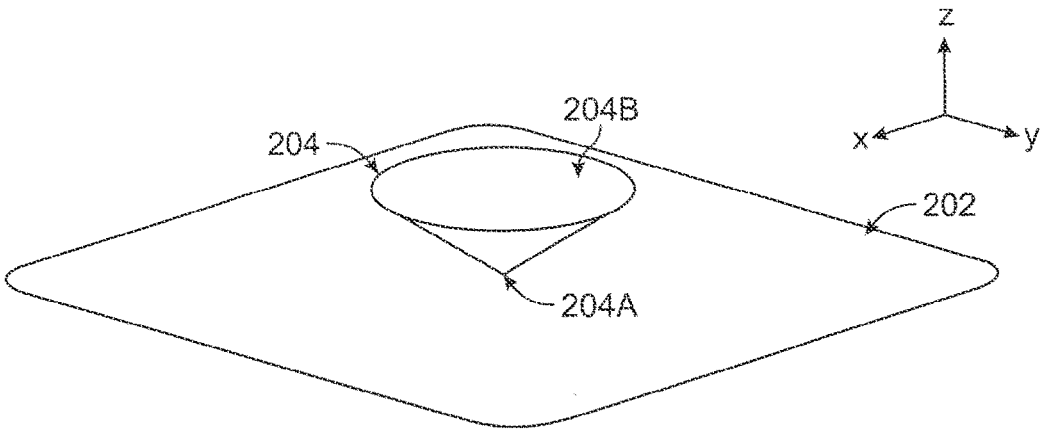
FIG. 2A is a diagram illustrating a perspective view of an example conical monopole antenna described herein.
Figure 2B:
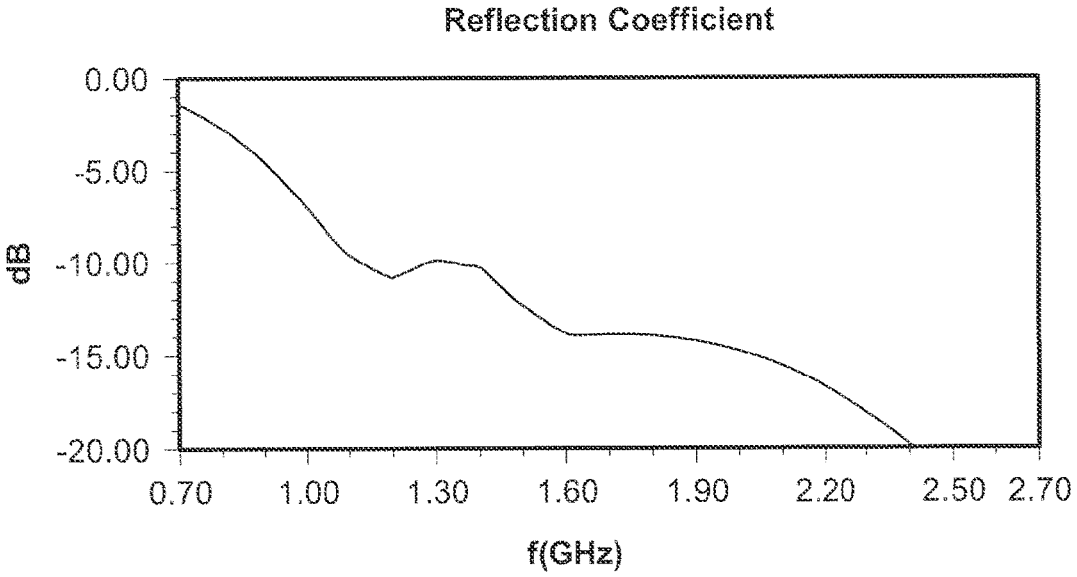
FIG. 2B is a graph illustrating the associated reflection coefficient of the conical monopole antenna shown in FIG. 2A between 0.7 GHz and 2.7 GHz.

Referring now to FIG. 2A, a diagram illustrating a perspective view of an example conical monopole antenna 204 is shown. Similar to FIG. 1A-1B, the conical monopole antenna 204 is arranged over a ground plane 202. In addition, the conical monopole antenna 204 has a conical shape with an apex 204A and a base 204B. The height of the conical monopole antenna 204 can be 0.09λ (e.g., 4 cm at 0.7 GHz, the lowest frequency in the continuous, wide-range frequency band). The height can be a distance between the apex 204A and the base 204B of the conical monopole antenna 204. Due to the relatively small height (e.g., the low profile of the conical monopole antenna), the conical monopole antenna 204 is inefficient as the frequency becomes lower. For example, the input impedance of the conical monopole antenna 204 is severely mismatched at low frequencies (e.g., below 1 GHz), which is illustrated by FIG. 2B.

Figure 3A:
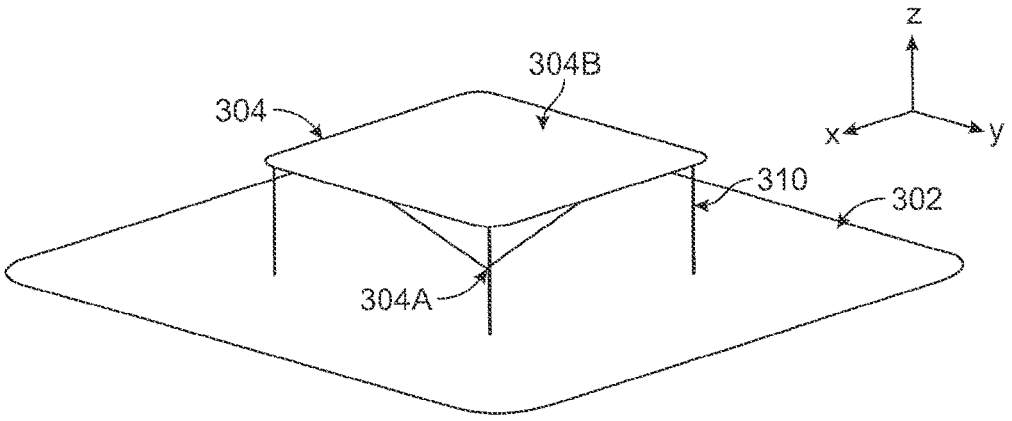
FIG. 3A is a diagram illustrating a perspective view of an example top-loaded conical monopole antenna described herein.
Figure 3B:
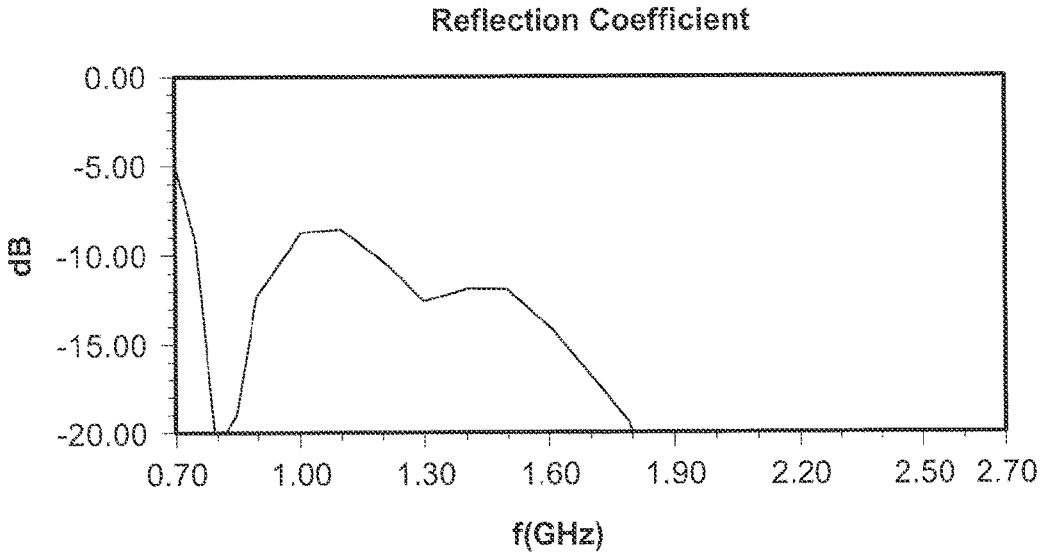
FIG. 3B is a graph illustrating the associated reflection coefficient of the top-loaded conical monopole antenna shown in FIG. 3A between 0.7 GHz and 2.7 GHz.

In order to obtain adequate impedance matching at low frequencies, the surface of the base of the conical monopole antenna can be enlarged, for example, to form a top-loaded conical monopole antenna. Referring now to FIG. 3A, a diagram illustrating a perspective view of an example top-loaded conical monopole antenna 304 is shown. Similar to FIGS. 1A-2A, the top-loaded conical monopole antenna 304 is arranged over a ground plane 302. The top-loaded conical monopole antenna 304 has a conical shape with an apex 304A and a base 304B. The base 304B of the top-loaded conical monopole antenna 304 extends outward, for example, beyond a directrix of the cone. In addition, one or more shorting pins 310 are provided to extend between the base 304B of the top-loaded monopole antenna 304 and the ground plane 302. The shorting pins 310 electrically connect the base 304B of the top-loaded monopole antenna 304 and the ground plane 302. As shown in FIG. 3A, shorting pins 310 are provided at each respective corner of the base 304B of the top-loaded monopole antenna 304. It should be understood that the number and/or arrangement of the shorting pins 310 are provided only as an example in FIG. 3A and that other numbers and/or arrangements can optionally be used. As shown in FIG. 3B, the modifications improve the impedance matching of the top-loaded conical monopole antenna 304 as compared to the conical monopole antenna described with regard to FIG. 2A. It is important to note that the shorting pins 310 produce a narrow-band resonance centered around approximately 0.8 GHz, which is also shown in FIG. 3B.

Figure 4A:
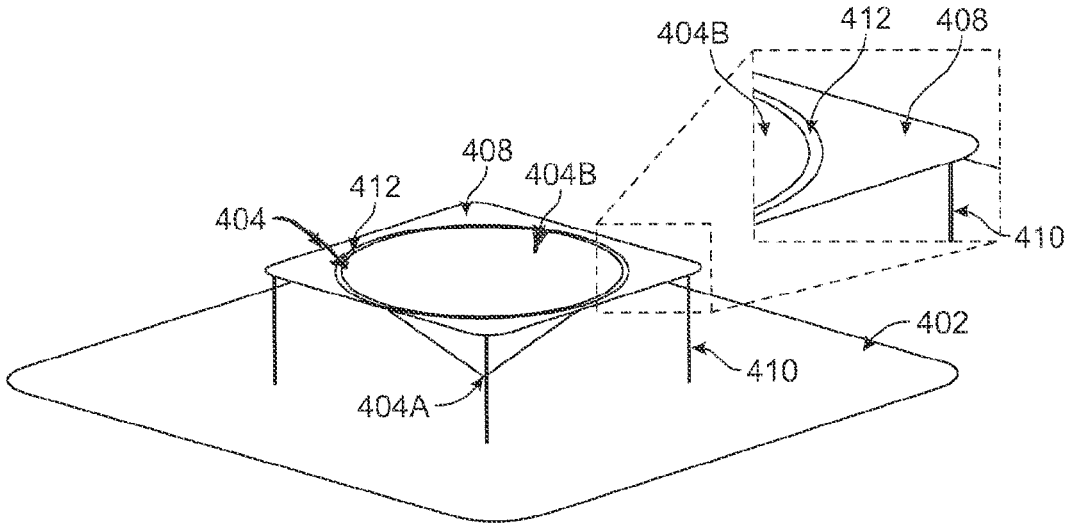
FIG. 4A is a diagram illustrating a perspective view of another example conical monopole antenna that incorporates a slot (e.g., an annular impedance tuning slot) to reduce the reflection coefficient.
Figure 4B:
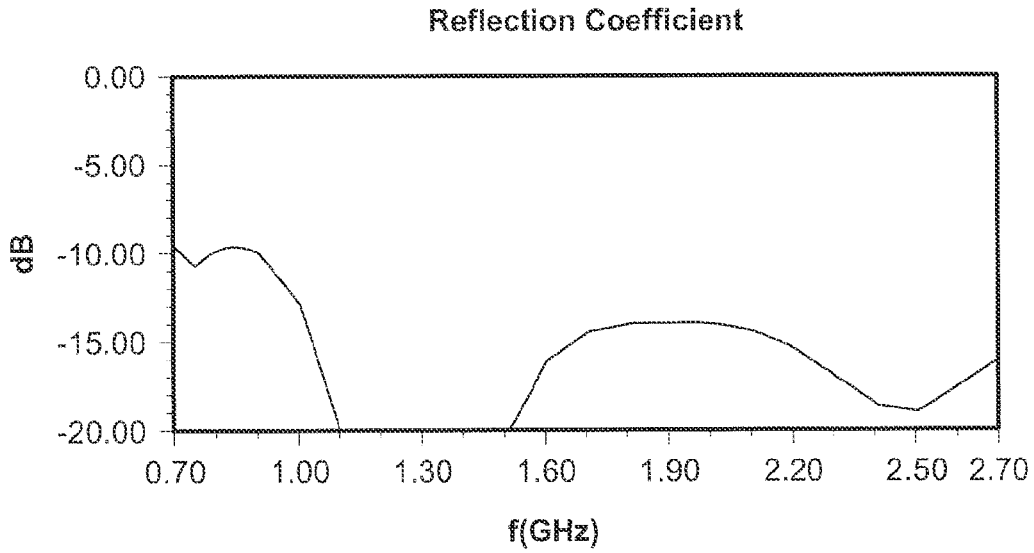
FIG. 4B is a graph illustrating the associated reflection coefficient of the conical monopole antenna shown in FIG. 4A between 0.7 GHz and 2.7 GHz. The addition of the slot (e.g., the annular impedance tuning slot) improves the reflection coefficient, which is demonstrated by comparing FIG. 4B and FIG. 3B, in particular, at frequencies below 1.6 GHz.

Referring now to FIG. 4A, a diagram illustrating a perspective view of another example conical monopole antenna 404 is shown. Similar to FIGS. 1A-2A and 3A, the conical monopole antenna 404 is arranged over a ground plane 402. The conical monopole antenna 404 has a conical shape with an apex 404A and a base 404B. In addition, a conductive plate 408 is arranged around the base 404B of the conical monopole antenna 404. In other words, the conductive plate 408 is arranged around or outside of a directrix of the conical-shaped, conical monopole antenna 404. The conductive plate 408 can optionally be approximately square-shaped as shown in FIG. 4A. For example, the conductive plate 408 can be a square-shaped ring (e.g., a square ring shape). Alternatively or additionally, the conductive plate 408 can have other shapes, for example other rotatably-symmetric shapes. In addition, one or more shorting pins 410 are provided to extend between the conductive plate 408 and the ground plane 402. The shorting pins 410 electrically connect the conductive plate 408 and the ground plane 402. As shown in FIG. 4A, shorting pins 410 are provided at each respective corner of the conductive plate 408. It should be understood that the number and/or arrangement of the shorting pins 410 are provided only as an example in FIG. 4A and that other numbers and/or arrangements can optionally be used. As described above, the shorting pins 410 cause a narrow-band resonance. Accordingly, a slot 412 is provided between the conductive plate 408 and the base 404B of the conical monopole antenna 404. The slot 412 can be an annular slot that surrounds the base 404B of the conical monopole antenna 404, for example. The slot 412 converts the conductive plate 408 into a ring (e.g., a square-shaped ring) around the conical monopole antenna 404. The slot 412 adds capacitance that cancels the inductive loading due to the shorting pins 410. A width of the slot 412 can be configured to widen the low-reflection narrow-band resonance produced by the shorting pins 410 (as shown in FIG. 4B). For example, the width of the slot 412 can optionally be approximately 1.5 mm. Alternatively or additionally, the width of the slot 412 can be greater or less than 1.5 mm as needed to widen the narrow-band resonance produced by the shorting pins 410. As described below, the UWB MIMO antenna can include a PCB, which is optionally arranged substantially parallel to the ground plane (e.g., the ground plane 402). The conductive plate (e.g., the conductive plate 408) can be disposed (e.g., printed) on a surface of the PCB facing the ground plane. As shown in FIG. 4B, the conductive plate 408, shorting pins 410 and slot 412 improve the impedance matching of the conical monopole antenna 404 as compared to the conical monopole antennas described with regard to FIGS. 2A and 3A and allows the conical monopole antenna 404 to cover the entire frequency band between 0.7 GHz and 2.7 GHz (and even higher).

Figure 5A:
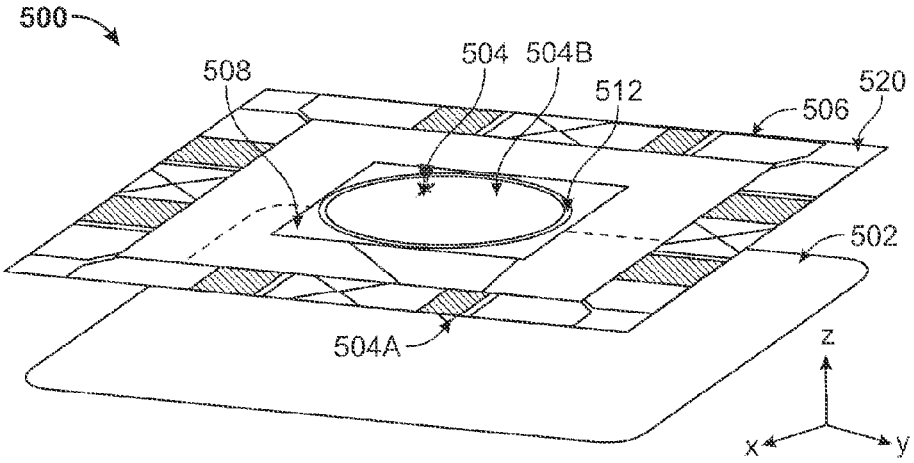
FIGS. 5A-5B are diagrams illustrating an example UWB MIMO antenna described herein.
Figure 5B:
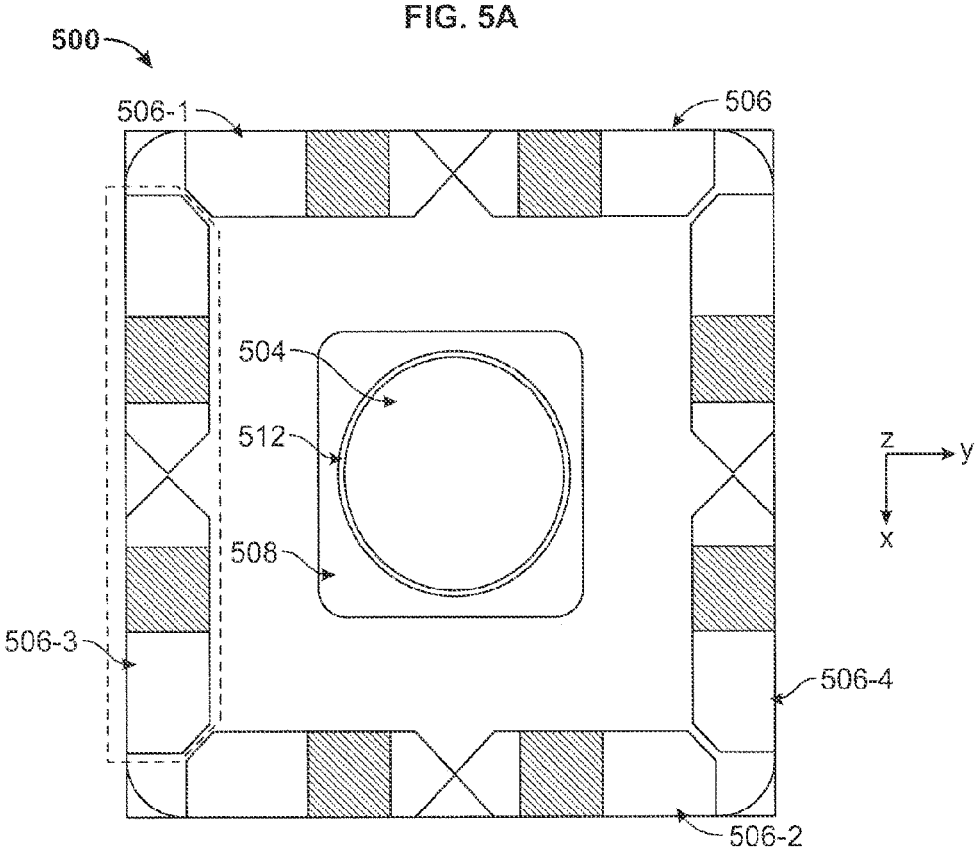

Referring now to FIGS. 5A-5B, diagrams illustrating an example UWB MIMO antenna 500 are shown. FIG. 5A is a diagram illustrating a perspective view of the UWB MIMO antenna 500, and FIG. 5B is a diagram illustrating a top view of the UWB MIMO antenna 500. The UWB MIMO antenna 500 includes a ground plane 502, a conical monopole antenna 504, and a ring antenna 506. The conical monopole antenna 504 is arranged over a center portion of the ground plane 502, and the ring antenna 506 is arranged over a peripheral portion of the ground plane 502. The ring antenna 506 is therefore arranged around the conical monopole antenna 504. In addition, the conical monopole antenna 504 is fed through the ground plane 502 at an excitation point. For example, as described below, the conical monopole antenna 504 is fed through a first port, e.g., a 50Ω port for connection with a coaxial cable. Optionally, if the impedance of the conical monopole antenna 504 is best matched using a higher-resistance reference (e.g., a 75Ω reference), a tapered microstrip (e.g., 50Ω-75Ω) can be used for excitation with a 50Ω coaxial cable. Additionally, the conical monopole antenna 504 has a conical shape that defines an apex 504A and a base 504B. In addition, similar as described in FIG. 4A, a conductive plate 508 is arranged around the base 504B of the conical monopole antenna 504. A slit 512 (e.g., an annular slit) is provided between the conductive plate 508 and the base 504B of the conical monopole antenna 504. As shown in FIG. 5A, the UWB MIMO antenna 500 can include a PCB 520, which is arranged in a plane approximately parallel to the ground plane 502. The conductive plate 508 can be disposed on a surface of the PCB 520 facing the ground plane 502. In other words, the conductive plate 520 can be provided on a bottom surface of the PCB 520.

The ring antenna 506 is approximately square-shaped (e.g., a square-shaped ring as shown in FIGS. 5A-5B). It should be understood, however, that the ring antenna 506 can be designed to have other shapes. The ring antenna 506 includes four dipole antennas 506-1, 506-2, 506-3, 506-4 (e.g., the two pairs of dipole antennas 106A, 106B shown in FIGS. 1A-1B). Although two pairs of dipole antennas are provided in the examples described herein, this disclosure contemplates using more than two pairs of dipole antennas (e.g., constructing the ring antenna with six, eight, ten, etc. dipole antennas). It should be understood that when additional dipole antennas are used to construct the ring antenna (with each dipole antenna arm having a length of ¼λ), the dimensions of the ring antenna may change and/or the operational frequency range may be limited. Each of the dipole antennas 506-1, 506-2, 506-3, 506-4 is fed through a respective excitation point. As described below, the ring antenna 506 is fed through a second port, e.g., a 50Ω port for connection with a coaxial cable. In addition, dipole antennas 506-1, 506-2 (e.g., a pair of dipole antennas) are arranged on opposite sides of the conical monopole antenna 504. Additionally, dipole antennas 506-1, 506-2 are configured to operate approximately 180° out-of-phase from each other. Similarly, dipole antennas 506-3, 506-4 (e.g., a pair of dipole antennas) are arranged on opposite sides of the conical monopole antenna 504. Additionally, dipole antennas 506-3, 506-4 are configured to operate approximately 180° out-of-phase from each other. Together, the four dipole antennas 506-1, 506-2, 506-3, 506-4 form the ring antenna 506. Because each respective dipole antenna of a pair of dipole antennas operates approximately 180° out-of-phase, the coupling attributable to each of the respective dipole antennas and the conical monopole antenna 504, respectively, is canceled out, which contributes to achieving high isolation between the conical monopole antenna 504 and the ring antenna 506.

Figure 5C:
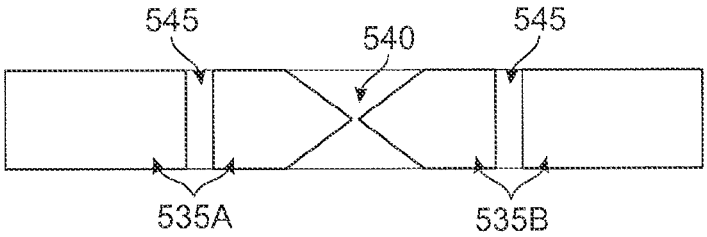
FIGS. 5C-5D are diagrams illustrating an example dipole antenna forming the ring antenna of the example UWB MIMO antenna described herein.
Figure 5D:
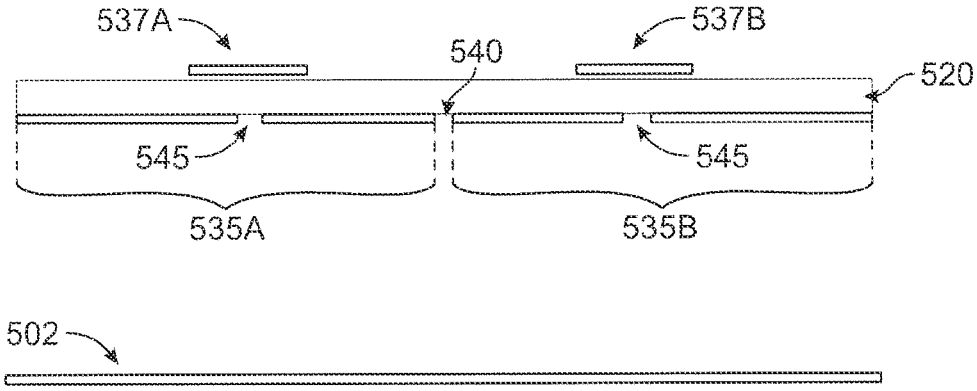

A ring antenna may exhibit multiband behavior with impedance mismatching at low frequencies. Mismatched impedance at low frequencies is caused by arranging the ring antenna at close proximity to the ground plane. As a result, the ring antenna may only radiate efficiently only at its supported modes, which are determined by the overall geometry of the ring antenna. This undesirable behavior can be addressed by controlling the coupling between the excitation points of the dipole antennas. For example, for each respective excitation point, if the reflected field from the ground plane and the coupled field from the other excitation points (e.g., the excitation points of the other dipole antennas) have different phases, the fields can cancel each other and adequate impedance matching can be achieved, even at low frequencies. In order to achieve adequate impedance matching, each of the dipole antennas 506-1, 506-2, 506-3, 506-4 can be a dipole antenna described with regard to FIGS. 5C-5D. For example, a dipole antenna can include a plurality of conductive arms 535A, 535B extending in opposite directions from an excitation point 540. The dipole antenna can be fed, for example through a feed circuit as described below, through the excitation point 540. Each of the conductive arms 535A, 535B can include one or more capacitive coupling points (e.g., coupling slits 545). For example, each of the conductive arms 535A, 535B can include a plurality of conductive coupling patches 537 (e.g., conductive patches 537A, 537B, collectively referred to herein as conductive patches 537), and the coupling slits 545 can be arranged between the conductive patches. In addition, as described above, the UWB MIMO antenna 500 can include the PCB 520. For example, as shown in FIG. 5D, the coupling slits 545 are arranged between conductive patches disposed on a first surface (e.g., the bottom surface) of the PCB 520. On the opposite surface (e.g., the top surface) of the PCB 520, the conductive patches 537A, 537B are disposed over the coupling slits 545. Capacitive coupling is achieved through the arrangement of the coupling slits 545 and the conductive patches. For example, capacitive coupling between conductive patches disposed on the bottom surface of the PCB 520 occurs via the coupling slits 545 and the conductive patches 537 arranged there between on the top surface of the PCB 520. A width and/or arrangement of the coupling slits 545 can be used to tune the capacitive coupling between the conductive patches, and thus, control the capacitive coupling between the dipole antennas forming the ring antenna (e.g., dipole antennas 506-1, 506-2, 506-3, 506-4 shown in FIGS. 5A-5B). Accordingly, it is possible to optimize the capacitive coupling to cancel the effect of ground plane and increase efficiency increases at low frequencies. In addition, the capacitive coupling also improves the high-frequency performance, for example, by creating additional modes due to each capacitive coupling point. Thus, ring antenna 506 can exhibit wideband performance capability, instead of multiband behavior at high frequencies.

The overall dimensions of the UWB MIMO antenna 500 can be 0.55λ×0.55λ×0.09λ. Based on the lowest frequency (e.g., 0.7 GHz) of the continuous, wide-range frequency band (e.g., 0.7-2.7 GHz), the overall dimensions of the UWB MIMO antenna 500 would be 24 cm×24 cm×4 cm. Additionally, the overall dimensions of the conductive plate 508 arranged around the base 504B of the conical monopole antenna 504 would be approximately 10 cm×10 cm, which leaves space for arranging the ring antenna over the peripheral portion of the ground plane 502. These dimensions make the UWB MIMO antenna 500 suitable for mounting in a ceiling of a building as described above (e.g., having a low profile).

The arrangement of the conical monopole antenna 504 and the ring antenna 506 described above achieves polarization diversity because the conical monopole antenna 504 and the ring antenna 506 generate respective electric fields having orthogonal polarizations. This contributes to achieving high isolation between the conical monopole antenna 504 and the ring antenna 506. Such high isolation implies that the antennas can be operated concurrently without interfering with each other. Additionally, the antenna feeding configuration can achieve a uniform radiation pattern, for example across the azimuth plane, as dimensions of the ring antenna become larger at a higher end of the continuous, wide-range frequency band (e.g., 0.7-2.7 GHz). Further, the feeding configuration ensures a null along the zenith of the aperture and delivers a radiation pattern that has its peak off-normal for better coverage of a room below, for example, when the UWB MIMO antenna 500 is mounted on a ceiling.

Figure 6:
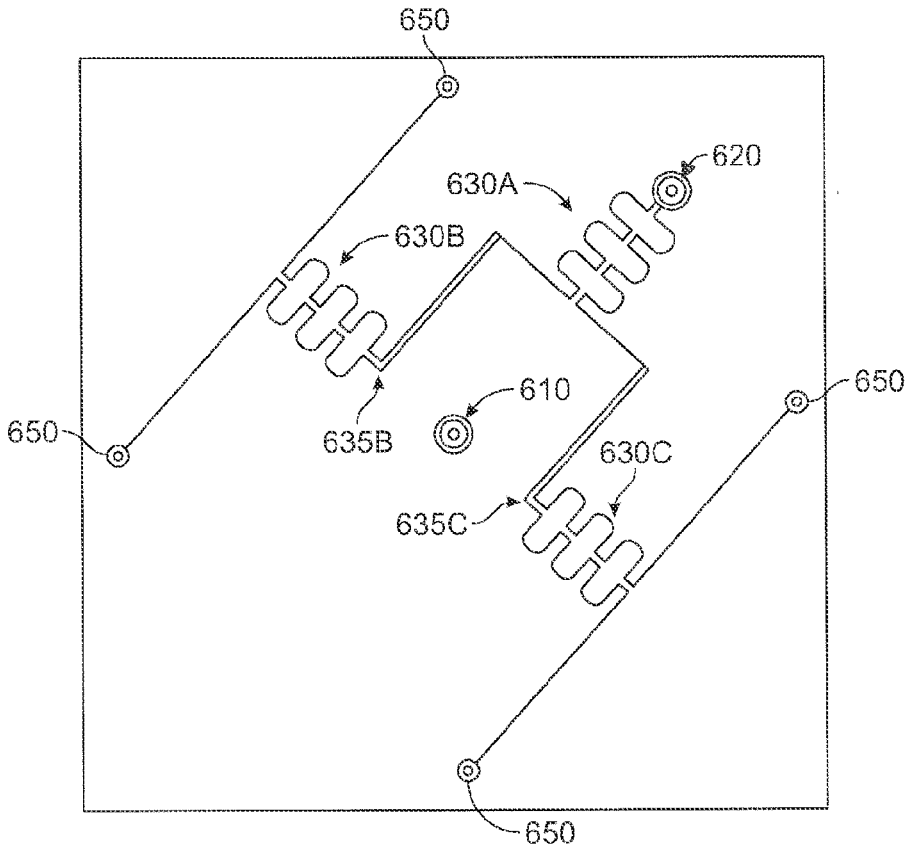
FIG. 6 is a schematic diagram illustrating an example feed network circuit (e.g., the "feed circuit" as described herein) for a UWB MIMO antenna described herein.

Referring now to FIG. 6, a schematic diagram illustrating an example feed network circuit (e.g., the "feed circuit" as described herein) 600 for a UWB MIMO antenna is shown. It should be understood that the UWB MIMO antenna can be configured as described above. For example, the UWB MIMO antenna can include a ground plane. The ground plane can be provided (e.g., printed) on a surface of a PCB, for example. The feed circuit 600 can optionally be provided (e.g., printed) on an opposite surface of this PCB. It should be understood that the PCB on which the ground plane and/or feed circuit 600 are provided is different than the PCB on which the conductive plate and/or dipole antennas are provided (e.g., PCB 520 shown in FIG. 5A). The feed circuit 600 can include a first port 610 for coupling with a conical monopole antenna of the UWB MIMO antenna and a second port 620 for coupling with a ring antenna of the UWB MIMO antenna. Each of the first and second ports 610, 620 can be a 50Ω port for connection with a coaxial cable, for example.

In order to feed the ring antenna, which includes a plurality of dipole antennas, of the UWB MIMO antenna, a power splitter can be used. As described above, the ring antenna can be formed with four dipole antennas (e.g., a plurality of pairs of dipole antennas), and each respective dipole antenna can be fed at an excitation point. In this case, a 1-to-4 power splitter can be used to excite the four dipole antennas. The feed circuit 600 can therefore include a cascaded set of power dividers (e.g., 50Ω-to-100Ω impedance transformers) that generates four output signals from a single input signal (e.g., the signal delivered by the coaxial cable connected to the second port 620). For example, a first impedance transformer 630A can divide an input signal supplied to the second port 620 into two output signals. Each of the output signals can be delivered to second and third impedance transformers 630B and 630C at points 635B and 635C, respectively. The second and third impedance transformers 630B and 630C can further divide these output signals, for example, into four output signals delivered at points 650. Each of the respective output signals output signals delivered at points 650 can be coupled to a respective excitation point of one of the dipole antennas forming the ring antenna. When using 50Ω-to-100Ω impedance transformers, each of the 100Ω outputs from the first impedance transformer 630A is tapered down to 50Ω before reaching the input of second and third impedance transformers 630B and 630C. The outputs of the second and third impedance transformers 630B, 630C may not need tapering because the input impedance of the baluns circuits (described below) is 100Ω.

Figure 7:
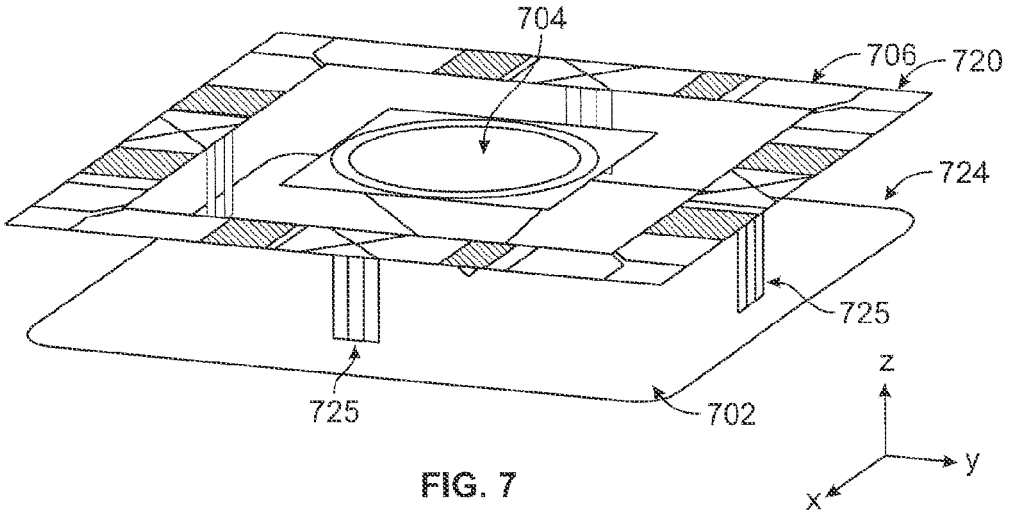
FIG. 7 is a diagram illustrating a perspective view of another example UWB MIMO antenna with balun circuits described herein.

Referring now to FIG. 7, a diagram illustrating a perspective view of another example UWB MIMO antenna is shown. The UWB MIMO antenna includes a ground plane 702, a conical monopole antenna 704 and a ring antenna 706. The ground plane 702, the conical monopole antenna 704 and the ring antenna 706 can have the same characteristics as those described in detail above, and therefore, these characteristics are not described in further detail below. As shown in FIG. 7, the UWB MIMO antenna includes a first PCB 720 on which at least portions of the conical monopole antenna 704 (e.g., a conductive plate) and/or the ring antenna 706 are disposed, as described above. Additionally, the UWB MIMO antenna includes a second PCB 724 on which the ground plane 702 is disposed. In addition, a feed circuit (e.g., the feed circuit 600 shown in FIG. 6) can be provided on an opposite surface of the second PCB 724 (e.g., under the ground plane 702). It should be understood that the feed lines for coupling the feed circuit and the ring antenna come up through the ground plane 702, e.g., the feed lines connect the respective outputs of the feed circuit (e.g., the output signals delivered at points 650 shown in FIG. 6) and the excitation points of the respective dipole antennas of the ring antenna 706. A balun circuit 725 can be used to couple the unbalanced feed of the feed circuit (e.g., an unbalanced coaxial or microstrip feed) to the balanced feed of the dipole antenna, which helps maintain high isolation between the conical monopole antenna 704 and the ring antenna 706. As shown in FIG. 7, the balun circuit 725 is arranged perpendicularly to the ground plane 702 and ensures low radiation leakage to sustain low cross-polarization.

Figure 8A:
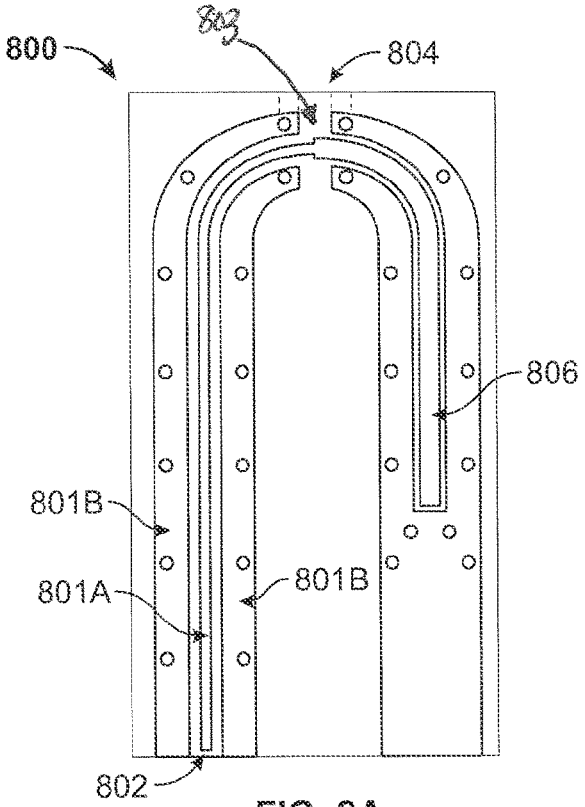
FIGS. 8A-8B are diagrams illustrating example PCB-implementations of a balun circuit.
Figure 8B:
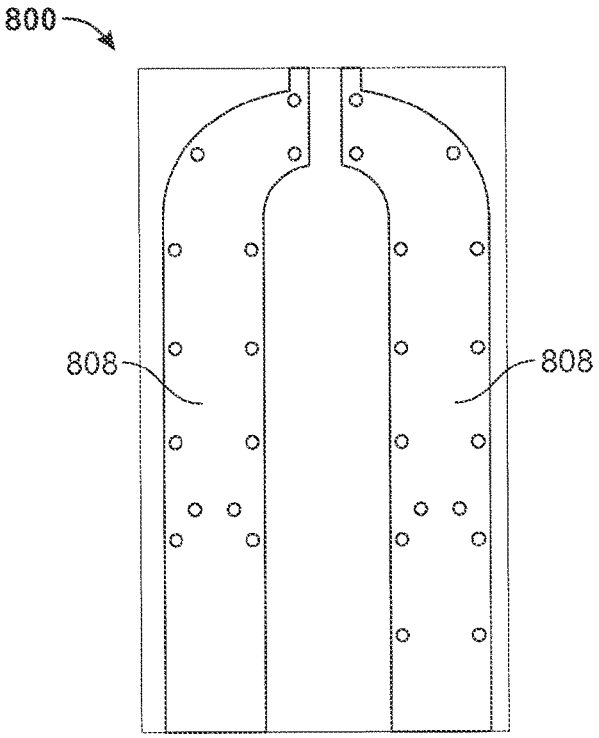

Balanced feeding of the ring antenna (e.g., any of the ring antennas shown in FIGS. 1A-2A, 3A, 4A and 5A) from an unbalanced circuit (e.g., the feed circuit 600 shown in FIG. 6) can be achieved using balun circuits. In a balun circuit, an unbalanced line drives a balanced line. One example balun circuit, which is well-known in the art, is a Marchand balun. Although Marchand-type balun circuits are used in the examples provided herein, it should be understood that other types of balun circuits can be used. Balanced feeding can be achieved with a PCB-implementation of the Marchand balun. Referring now to FIGS. 8A-8B, diagrams illustrating an example PCB-implementation of a balun circuit 800 are shown. FIG. 8A is a diagram illustrating a first side of the balun circuit 800 (i.e., a front side of the PCB). FIG. 8B is a diagram illustrating a second side (or opposite side) of the balun circuit 800 (i.e., a back side of the PCB). The balun circuit 800 is capable of transforming an unbalanced input (e.g., a 100Ω, unbalanced output from the feed circuit 600 shown in FIG. 6) to a balanced output (e.g., a 100Ω, balanced output for feeding an excitation point of a dipole antenna). For example, as shown in FIG. 8A, an unbalanced feed port 802 begins as a grounded co-planar waveguide ("GCPW") and transitions to an open stub 806. In particular, from the unbalanced feed port 802, a center conductor 801A extends between an outer shield 801B. The unbalanced feed port 802 can be coupled to an output of the feed circuit (e.g., one of the output signals delivered at points 650 shown in FIG. 6). Point 803 corresponds to a feed gap of one of the dipole antenna and is therefore exposed in order to excite the dipole antenna. For example, a balanced feed port 804 can be coupled to the excitation point of the dipole antenna. Beyond point 803, the center conductor 801A continues extending between the outer shield 801B to an opposite side of the balun circuit 800 to form the open stub 806 (i.e., a microstrip). A length of the open stub 806 is adjustable subject to the desired bandwidth and impedance of the dipole antenna. Additionally, as shown in FIG. 8B, additional outer shields 808 of the GCPW form the shorted shunt stub.

Figure 9A:
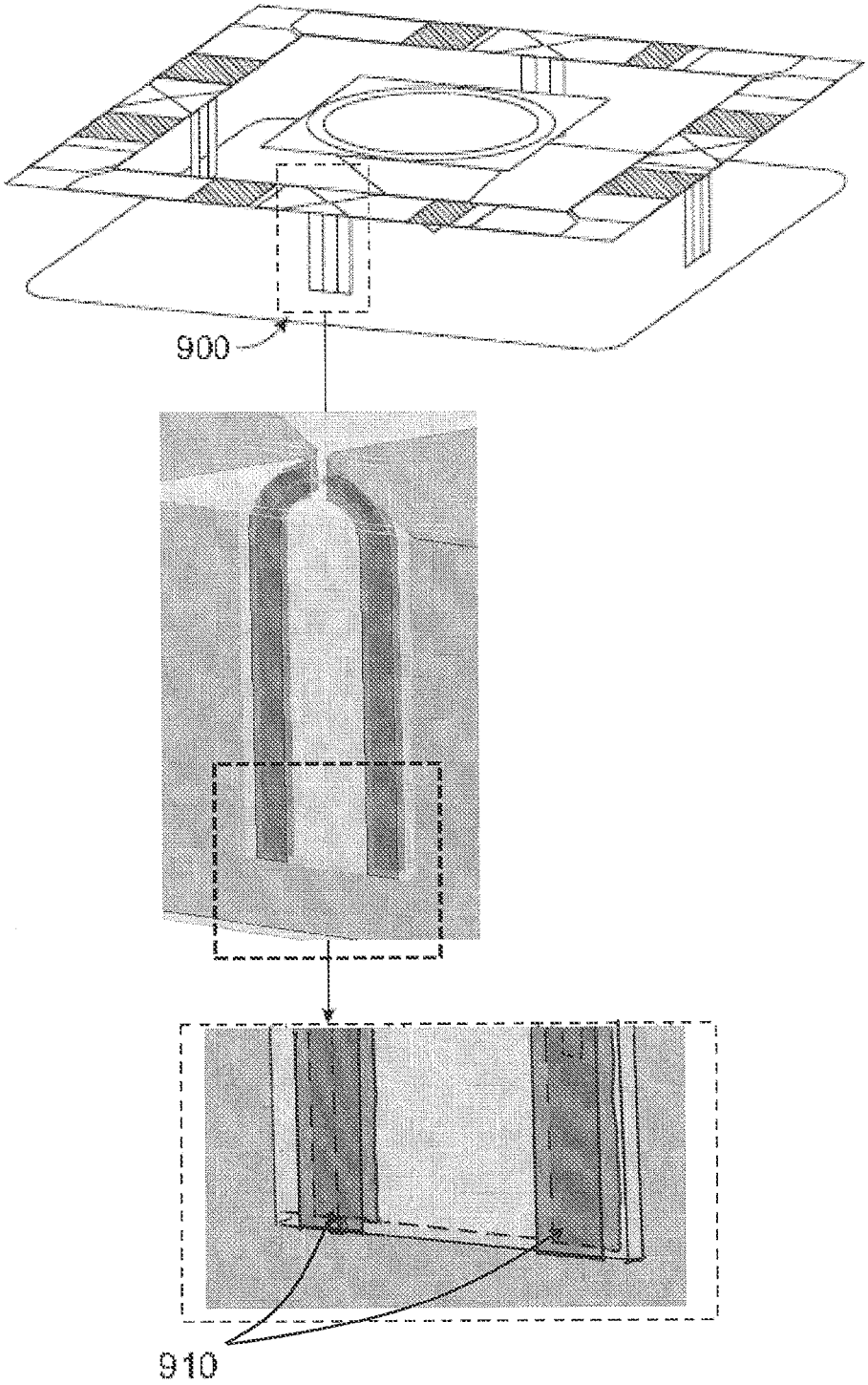
FIG. 9A is a diagram illustrating an example 3-layer balun circuit.
Figure 9B:
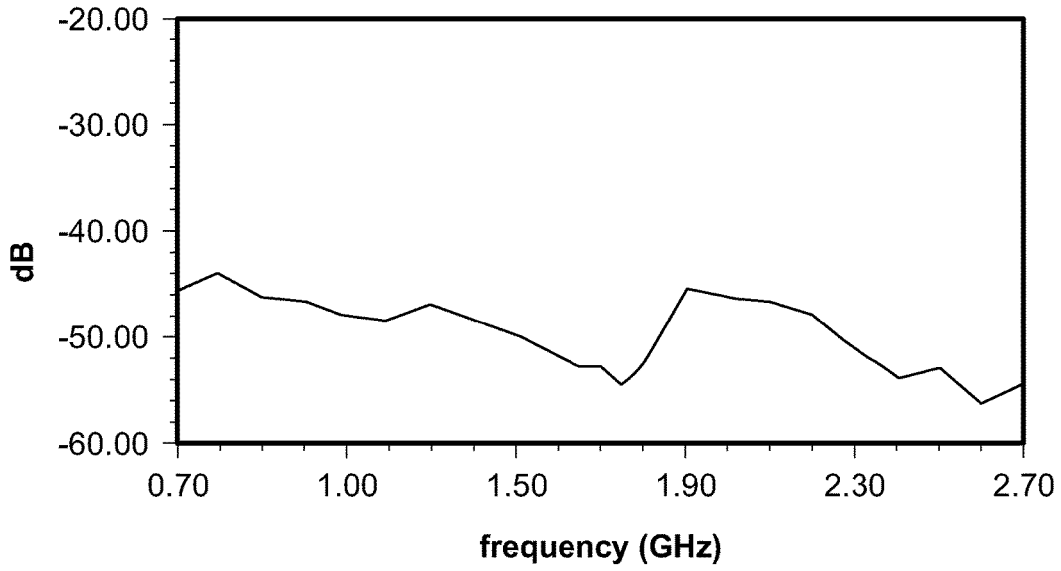
FIG. 9B is a graph illustrating coupling between an example conical monopole antenna and ring antenna using a 3-layer balun circuit.
Figure 10A:
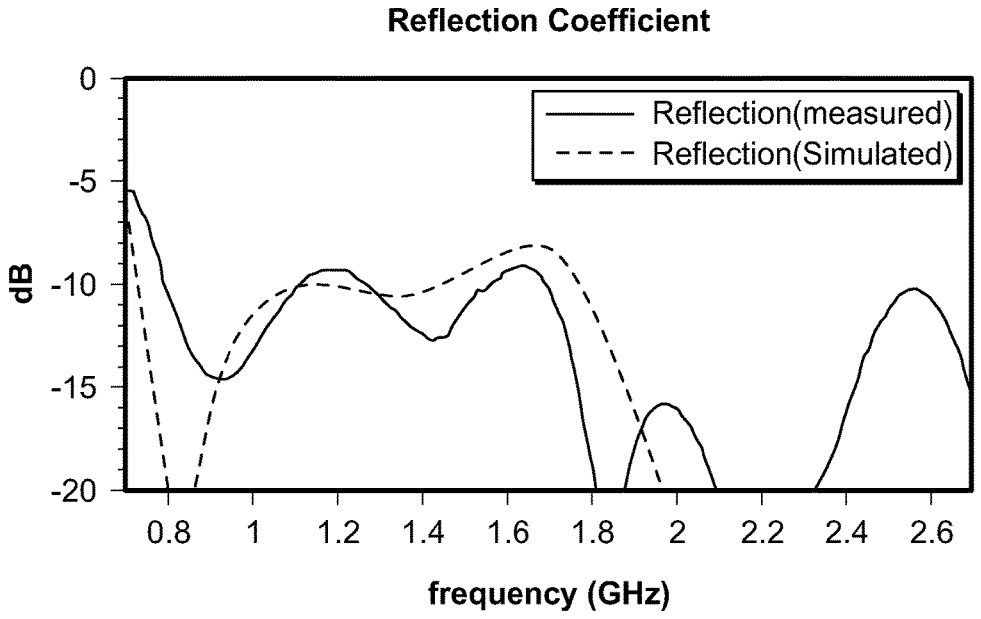
FIGS. 10A-10B are graphs illustrating reflection coefficients (measured and simulated) for an example co-located conical monopole antenna and ring antenna described herein.
Figure 10B:
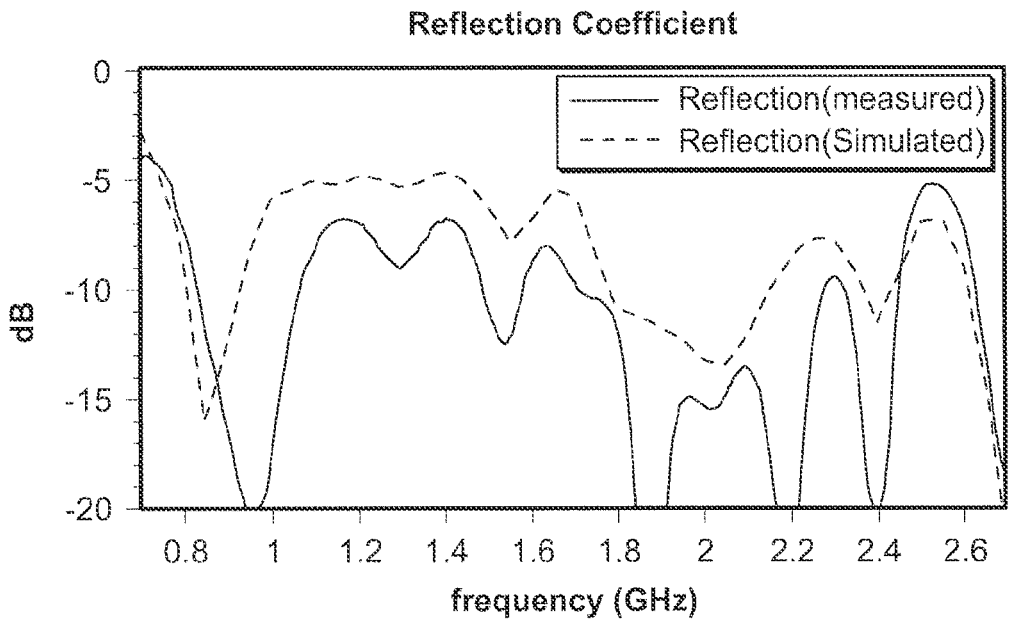
Figure 10C:
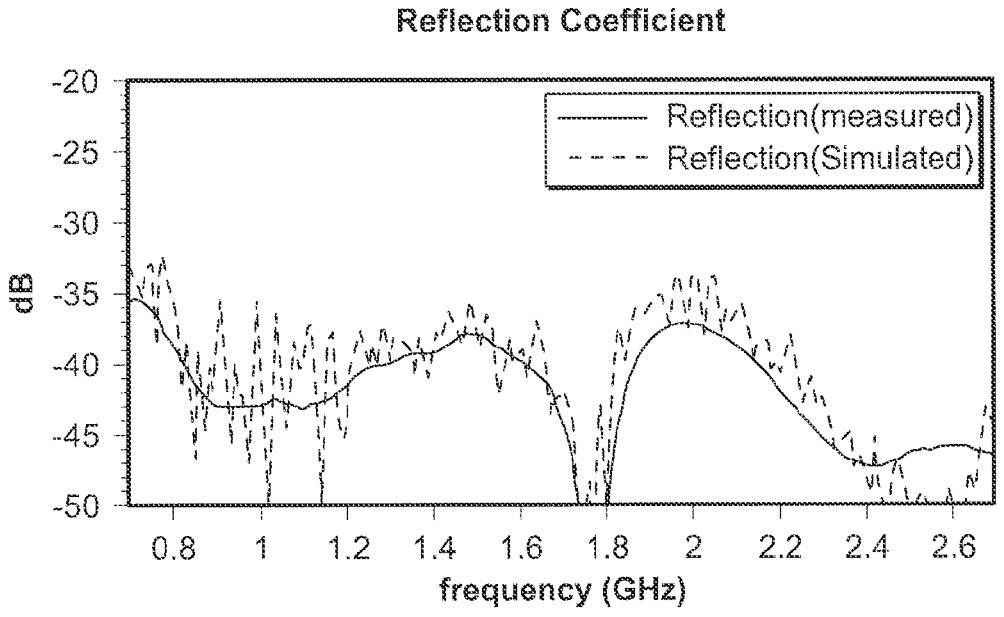
FIG. 10C is a graph illustrating coupling between the co-located conical monopole antenna and ring antenna between 0.7 GHz and 2.7 GHz. As shown, there is low coupling (and high isolation) between the conical monopole antenna and ring antenna over the entire frequency range. In particular, the coupling is −40 dB over the entire frequency range, with the exception at low frequencies near 0.7 GHz and between 1.8 GHz to 2.2 GHz where it is −35 dB.
Figure 11:
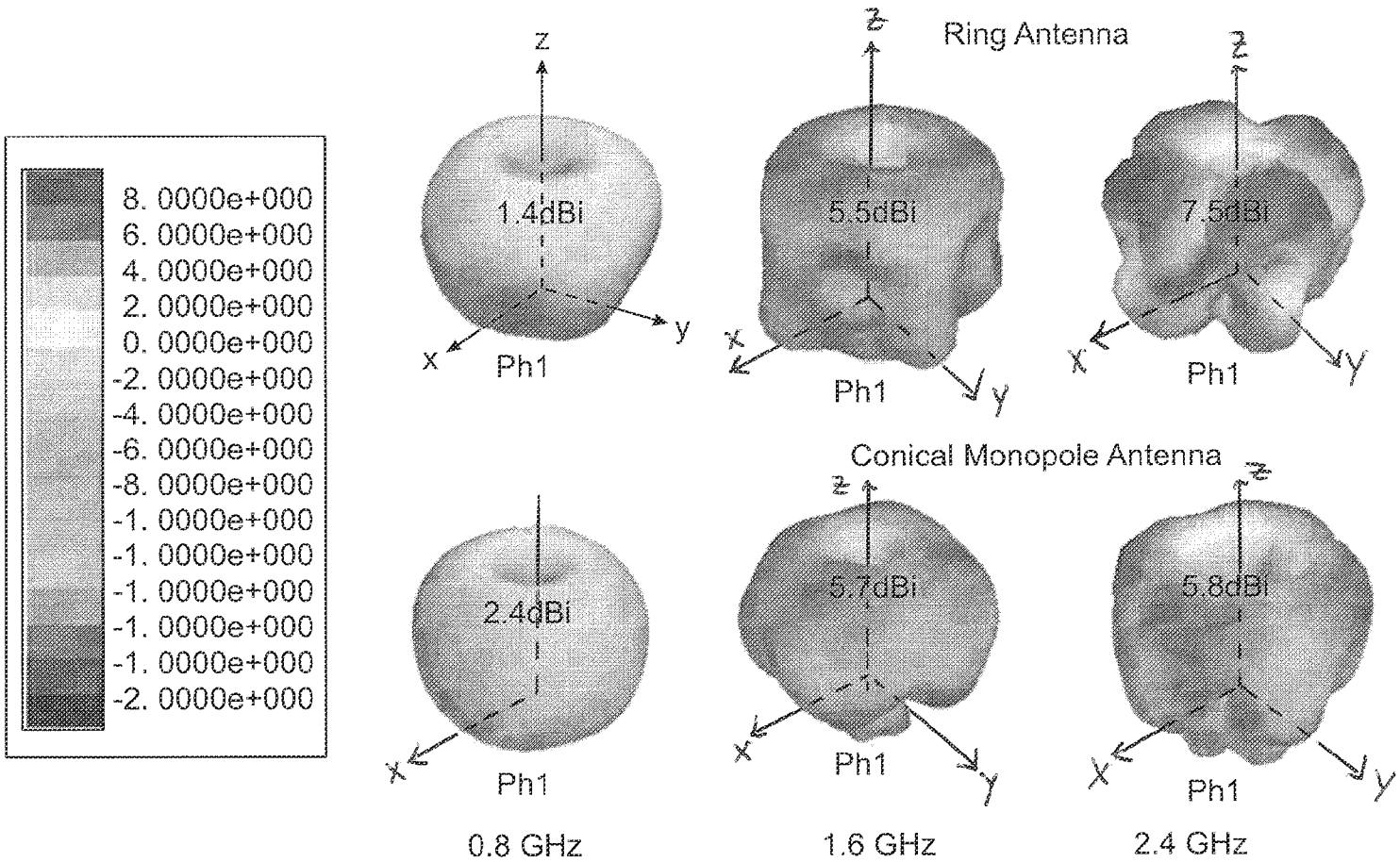
FIG. 11 illustrates simulated 3D-patterns for an example co-located conical monopole and ring antennas described herein. The maximum gain values at given frequencies are shown.
Figure 12:
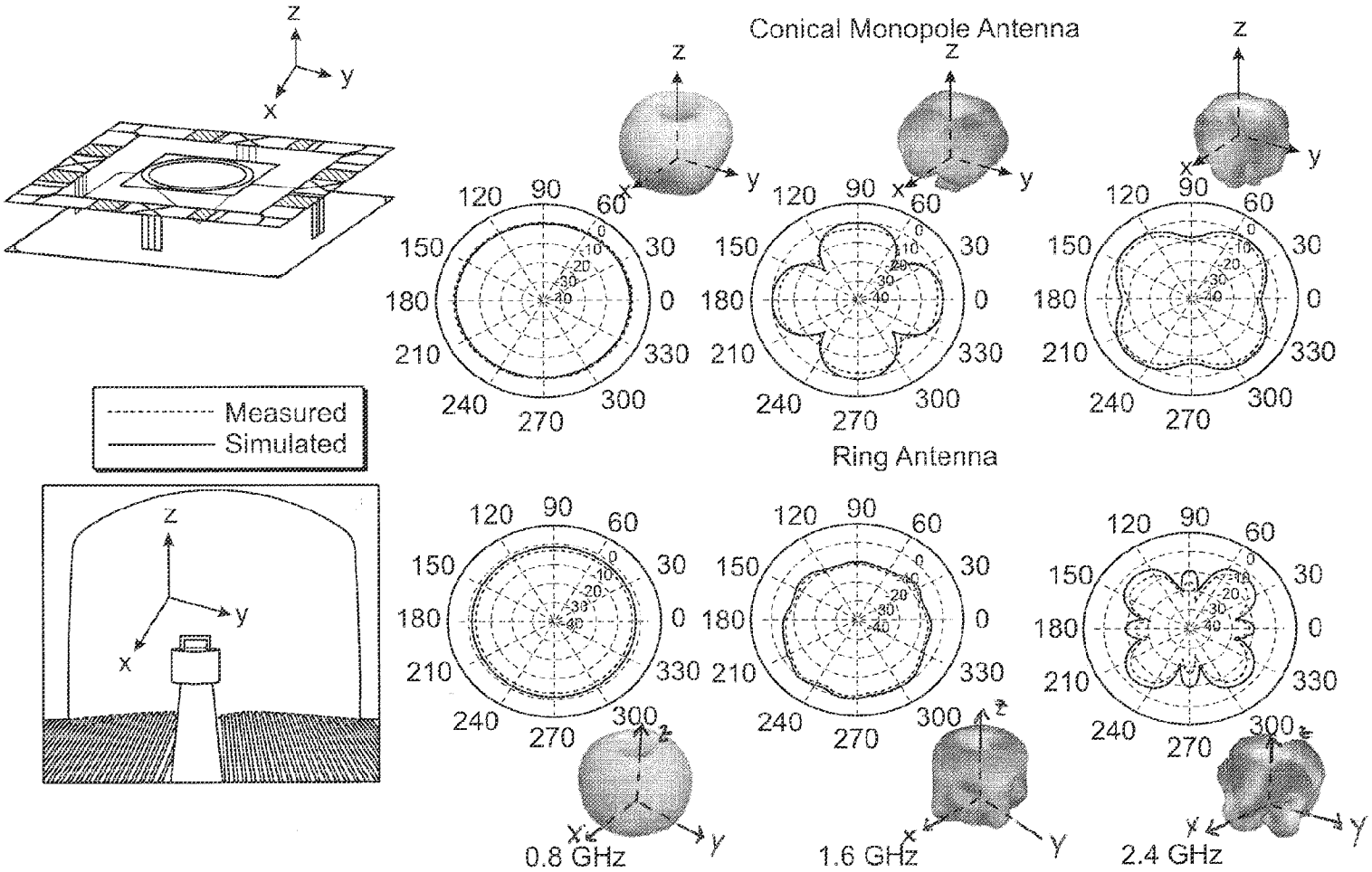
FIG. 12 illustrates 2D total realized gain for the example co-located conical monopole and ring antennas in the azimuth (X-Y) plane. In particular, simulated (solid line) and measured (dashed line) pattern cuts in the azimuth plane are shown.
Figure 13:
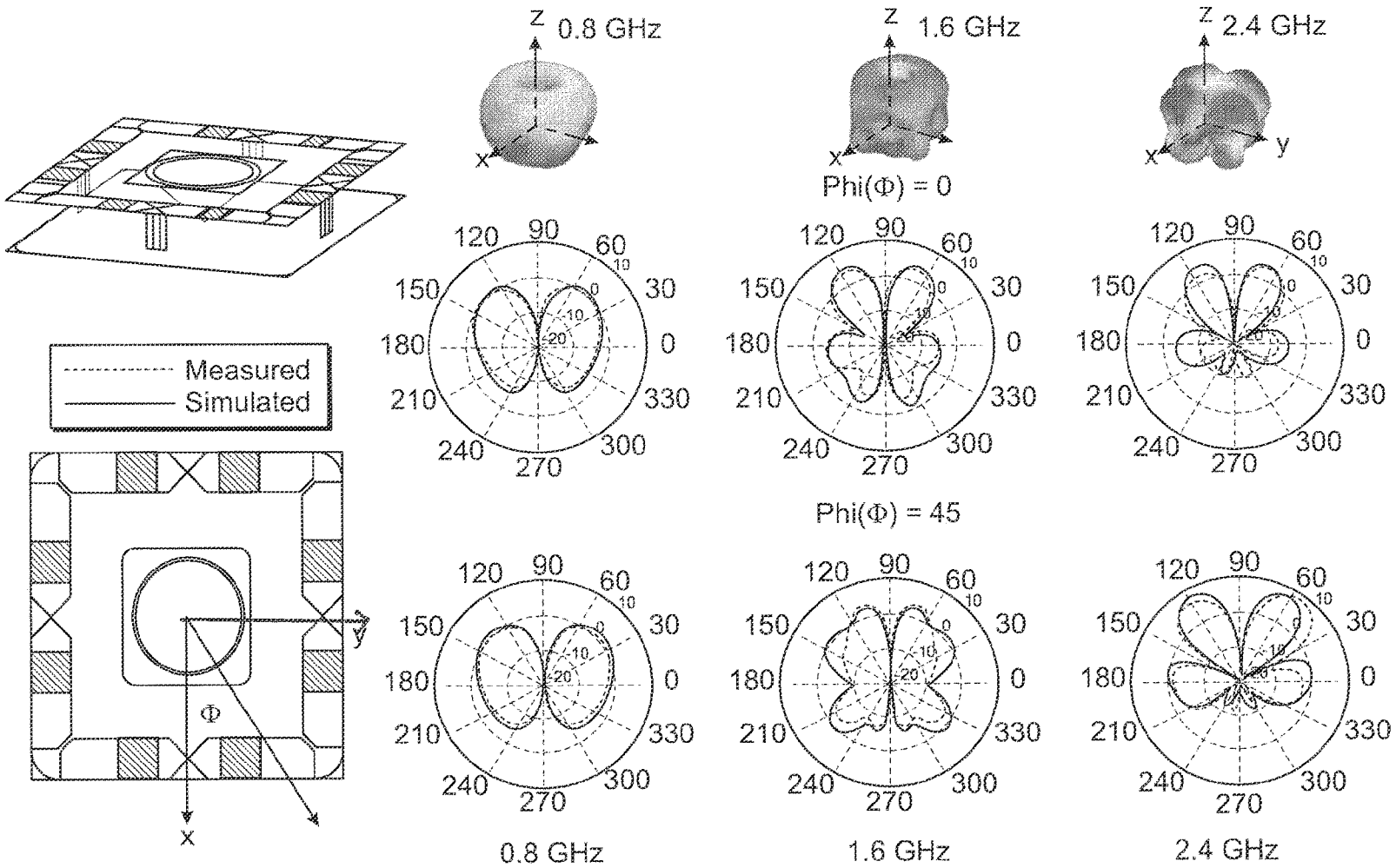
FIG. 13 illustrates 2D total realized gain for the example ring antenna in the elevation (ϕ) plane. In particular, simulated (solid line) and measured (dashed line) pattern cuts in the elevation plane are shown.
Figure 14:
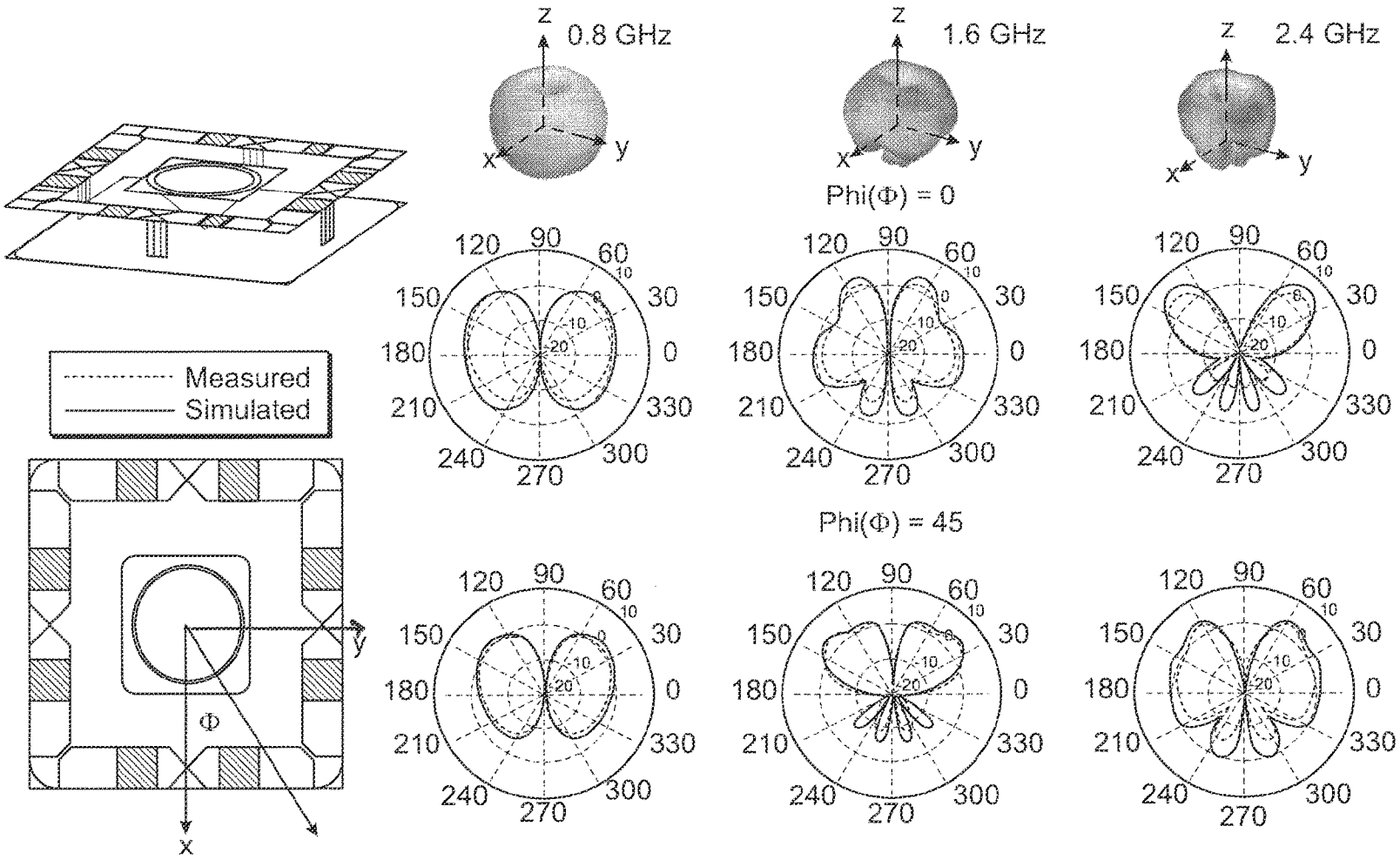
As shown in FIG. 14, the radiation pattern is substantially omnidirectional in the azimuth plane over the continuous, wide-range frequency band (e.g., as illustrated by the pattern cut examples at discrete frequencies within the 0.7-2.7 GHz range).

Referring now to FIG. 9A, a diagram illustrating another example PCB-implementation of a balun circuit 900 is shown. As compared to the balun circuit 800 shown in FIGS. 8A-8B, the balun circuit 900 has a 3-layer structure. As shown in FIG. 8A, a length of the outer shield 801B on the unbalanced-input-side of the balun circuit 800 is not equal to a length of the outer shield 801B on the open-stub-side of the balun circuit 800. This is because the center conductor 801A on the open-stub-side does not extend the entire length to the ground plane, while the center conductor 801A on the unbalanced-input-side does extend the entire length to the ground plane. This causes unbalance in the two legs of the balun circuit 800. It is possible to increase symmetry of the balun structure, and also improve the isolation between the conical monopole antenna and the ring antenna, using the balun circuit 900. As shown in FIG. 9A, an outer conductor layer 910 is provided to shield the center conductor (e.g., center conductor 801A shown in FIG. 8A) and outer shield (e.g., outer shield 801B shown in FIG. 8A). In other words, the input line of balun circuit becomes a strip line, shielded from both sides. As such the two legs of the balun circuit 900 are simply identical conductors. Accordingly, the shorted stub of the balun circuit becomes perfectly symmetric from the outside. FIG. 9B is a graph illustrating coupling between an example conical monopole antenna and ring antenna using a 3-layer balun circuit. As shown in FIG. 9B, the minimum isolation level is 44 dB. Impedance matching remains the same as when the PCB-implementation of the balun circuit described with regard to FIGS. 8A-8B is used.

As described above, the feed circuit (e.g., the feed circuit 600 shown in FIG. 6) can be used to excite the ring antenna of the UWB MIMO antenna and generate a unidirectional current (e.g., a unidirectional loop current in the ring antenna) in the ring antenna. To achieve a unidirectional current, respective dipole antennas of a pair of dipole antennas (e.g., dipole antennas arranged on opposite sides of the conical monopole antenna) can be excited with opposite polarities. For example, with reference again to FIG. 5B, dipole antennas 506-1 and 506-2 (i.e., a pair of dipole antennas) can be excited with opposite polarities. This can be achieved, for example, by flipping the placement of the balun circuits (described above) that couple the excitation points of dipole antennas 506-1 and 506-2. Additionally, dipole antennas 506-3 and 506-4 (i.e., a pair of dipole antennas) can be excited with opposite polarities. This can be achieved, for example, by flipping the placement of the balun circuits (described above) that couple the excitation points of dipole antennas 506-3 and 506-4.

Figure 15:
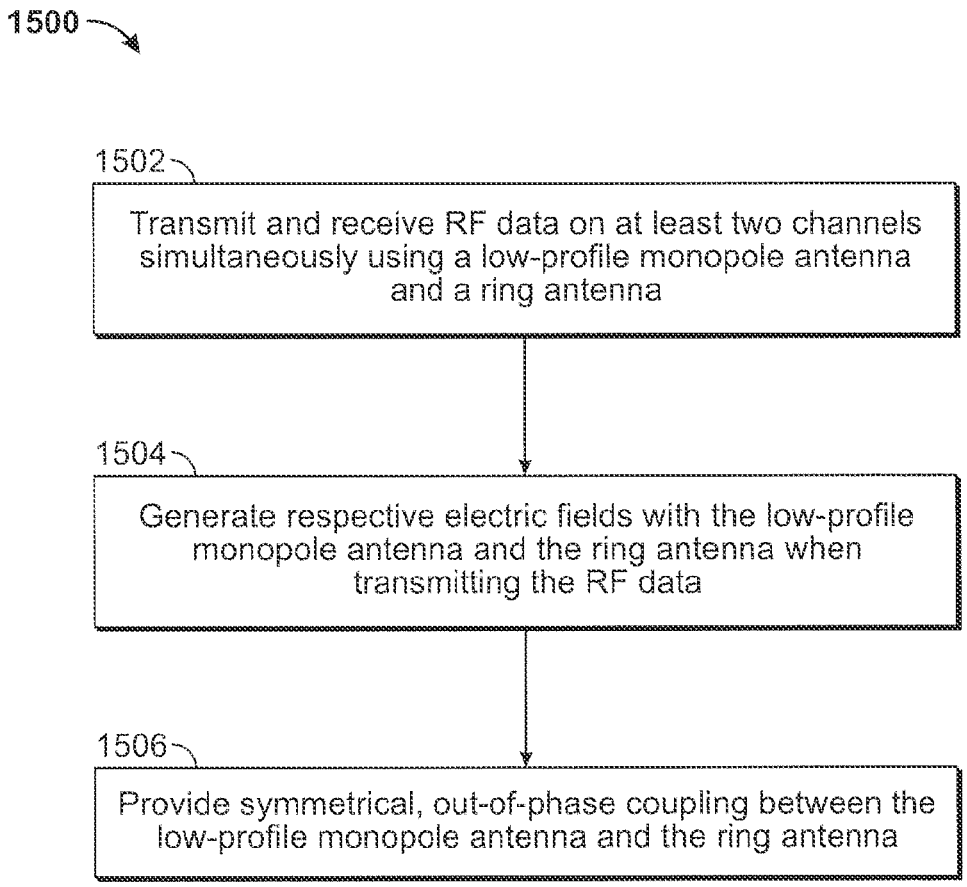
FIG. 15 is a flow diagram illustrating example operations for communicating RF data.

Referring now to FIG. 15, a flow diagram illustrating example operations 1500 for communicating RF data is shown. At 1502, the RF data is transmitted and received on at least two channels simultaneously. The RF data can be transmitted using a wideband monopole antenna (e.g., a low-profile monopole antenna) or a ring antenna, and the RF data can be simultaneously received using the other of the wideband monopole antenna or the ring antenna. In other words, the RF data can be transmitted by one antenna and received by the other antenna at substantially the same time. It should be understood that the wideband monopole antenna and/or the ring antenna can be configured according to the descriptions provided herein. At 1504, respective electric fields are generated with the wideband monopole antenna and the ring antenna when transmitting the RF data. The respective electric fields have orthogonal polarizations. At 1506, symmetrical, out-of-phase coupling is provided between the wideband monopole antenna and the ring antenna. Similar as described above, the generation of the respective electric fields having orthogonal polarizations and/or the symmetrical, out-of-phase coupling between the wideband monopole antenna and the ring antenna provide high isolation between the wideband monopole antenna and the ring antenna over the continuous, wide-range frequency band. Alternatively or additionally, a substantially omnidirectional radiation pattern in an azimuth plane can be generated with the wideband monopole antenna and the ring antenna when transmitting the RF data over the continuous, wide-range frequency band. Alternatively or additionally, the ring antenna can be fed to generate a unidirectional current in the ring antenna.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. An ultra-wideband ("UWB") multiple-input multiple-output ("MIMO") antenna for use across a continuous, wide-range frequency band, comprising:

a ground plane;

a wideband monopole antenna arranged over the ground plane; and a ring antenna arranged over the ground plane and around the wideband monopole antenna, the ring antenna including a plurality of pairs of dipole antennas, wherein respective dipole antennas of each of the pairs of dipole antennas are configured for symmetrical, out-of-phase coupling with the wideband monopole antenna, wherein the wideband monopole antenna and the ring antenna are configured to generate respective electric fields having orthogonal polarizations, wherein the ring antenna is approximately square-shaped, wherein each of the respective dipole antennas comprises a plurality of conductive arms extending in opposite directions from an excitation point, wherein each of the conductive arms comprises a plurality of conductive patches, and wherein one or more coupling slits are arranged between the conductive patches of each of the conductive arms.

2. The UWB MIMO antenna of claim 1, wherein the respective electric fields generated by the wideband monopole antenna and the ring antenna are highly isolated or decoupled across the continuous, wide-range frequency band.

3. The UWB MIMO antenna of claim 2, wherein the high isolation is at least 35 dB.

4. The UWB MIMO antenna of claim 1, wherein the wideband monopole antenna comprises a conical monopole antenna having a conical shape with an apex and a base opposite to the apex, and the UWB MIMO antenna further comprises a conductive plate arranged around the base of the conical monopole antenna.

5. The UWB MIMO antenna of claim 4, wherein the conductive plate is approximately square-shaped.

6. The UWB MIMO antenna of claim 4, wherein a distance between the apex and the base of the conical monopole antenna is approximately 0.09λ at a lowest frequency of the continuous, wide-range frequency band.

7. The UWB MIMO antenna of claim 6, wherein the distance is approximately 4 cm.

8. The UWB MIMO antenna of claim 4, further comprising a printed circuit board ("PCB") arranged over the ground plane, wherein the conductive plate is disposed on a surface of the PCB facing the ground plane.

9. The UWB MIMO antenna of claim 4, further comprising at least one shorting pin extending between the conductive plate and the ground plane.

10. The UWB MIMO antenna of claim 9, wherein the at least one shorting pin is four shorting pins, and wherein each respective shorting pin extends between a respective corner of the conductive plate and the ground plane.

11. The UWB MIMO antenna of claim 9, wherein a slot is arranged between the conductive plate and the base of the conical monopole antenna.

12. The UWB MIMO antenna of claim 11, wherein a width of the slot is configured to reduce narrow-band resonance caused by the at least one shorting pin.

13. The UWB MIMO antenna of claim 12, wherein the width of the slot is approximately 1.5 mm.

14. The UWB MIMO antenna of claim 1, wherein the respective dipole antennas of each of the pairs of dipole antennas are arranged on opposite sides of the wideband monopole antenna.

15. The UWB MIMO antenna of claim 14, wherein the respective dipole antennas of each of the pairs of dipole antennas are configured for operation approximately 180° out-of-phase.

16. The UWB MIMO antenna of claim 1, wherein a width or arrangement of the one or more coupling slits is selected to tune capacitive coupling between the conductive patches.

17. The UWB MIMO antenna of claim 1, further comprising a printed circuit board ("PCB") arranged over the ground plane, wherein the conductive patches are disposed on opposite surfaces of the PCB.

18. The UWB MIMO antenna claim 1, further comprising:

a first port coupled to the wideband monopole antenna; and a second port coupled to the ring antenna.

19. The UWB MIMO antenna of claim 18, further comprising a feed network circuit including an input coupled to the second port and a plurality of outputs coupled to the excitation points of each of the respective dipole antennas.

20. The UWB MIMO antenna of claim 19, wherein the feed network circuit is configured to split power of an excitation signal supplied to the input among the plurality of outputs.

21. The UWB MIMO antenna of claim 20, wherein the excitation signal generates a unidirectional current in the ring antenna.

22. The UWB MIMO antenna of claim 20, further comprising a plurality of balun circuits, wherein each of the balun circuits couples to one of the respective outputs of the feed network circuit and to one of the excitation points.

23. The UWB MIMO antenna of claim 22, wherein the balun circuits are Marchand-type balun circuits.

24. The UWB MIMO antenna of claim 22, wherein the balun circuits are coupled to supply the excitation signal with opposite polarities to the excitation points of each of the respective dipole antennas.

25. The UWB MIMO antenna of claim 1, wherein the wideband monopole antenna and the ring antenna are further configured to generate a substantially omnidirectional radiation pattern in an azimuth plane over the continuous, wide-range frequency band.

26. The UWB MIMO antenna of claim 1, wherein the continuous, wide-range frequency band is between approximately 0.7 GHz and 2.7 GHz.

27. A method for communicating radio frequency ("RF") data, comprising:

transmitting and receiving the RF data on at least two channels simultaneously, wherein the RF data is transmitted using a wideband monopole antenna or a ring antenna and the RF data is simultaneously received using the other of the wideband monopole antenna or the ring antenna;

generating respective electric fields with the wideband monopole antenna and the ring antenna when transmitting the RF data, wherein the respective electric fields have orthogonal polarizations; and providing symmetrical, out-of-phase coupling between the wideband monopole antenna and the ring antenna, wherein the wideband monopole antenna and the ring antenna are arranged over a ground plane, wherein the ring antenna is arranged around the wideband monopole antenna, wherein the ring antenna includes a plurality of pairs of dipole antennas, wherein the ring antenna is approximately square-shaped, wherein each of the respective dipole antennas comprises a plurality of conductive arms extending in opposite directions from an excitation point, wherein each of the conductive arms comprises a plurality of conductive patches, and wherein one or more coupling slits are arranged between the conductive patches of each of the conductive arms.

28. The method of claim 27, wherein at least one of the generation of the respective electric fields having orthogonal polarizations or the symmetrical, out-of-phase coupling between the wideband monopole antenna and the ring antenna provides high isolation between the wideband monopole antenna and the ring antenna over a continuous, wide-range frequency band.

29. The method of claim 28, wherein the continuous, wide-range frequency is between approximately 0.7 GHz and 2.7 GHz.

30. The method of claim 29, further comprising generating a substantially omnidirectional radiation pattern in an azimuth plane with the wideband monopole antenna and the ring antenna when transmitting the RF data over the continuous, wide-range frequency band.

31. The method of claim 28, wherein the high isolation is at least 35 dB.

32. The method of claim 27, further comprising feeding the ring antenna to generate a unidirectional current in the ring antenna.

* * * * *